US008800147B2

(12) United States Patent
Yanagisawa et al.

(10) Patent No.: US 8,800,147 B2
(45) Date of Patent: Aug. 12, 2014

(54) ALIGNMENT METHOD OF LIQUID-JET HEAD UNIT

(75) Inventors: Isao Yanagisawa, Chino (JP); Yasuo Inaoka, Shiojiri (JP); Takuma Okamuro, Fujimi-maci (JP); Kazutoshi Goto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1304 days.

(21) Appl. No.: 11/854,800

(22) Filed: Sep. 13, 2007

(65) Prior Publication Data

US 2008/0068420 A1 Mar. 20, 2008

(30) Foreign Application Priority Data

Sep. 14, 2006 (JP) ..... 2006-249860

(51) Int. Cl.
*B41J 29/393* (2006.01)

(52) U.S. Cl.
USPC ..... 29/890.1; 29/407.03; 347/40; 347/44

(58) Field of Classification Search
USPC ..... 29/890.1, 407.03, 59, 760; 347/40, 44, 347/45, 47; 228/56.3
See application file for complete search history.

(56) References Cited

U.S. PATENT DOCUMENTS

| | | | | |
|---|---|---|---|---|
| 5,350,105 | A * | 9/1994 | Delalle et al. | 228/56.3 |
| 7,328,965 | B2 | 2/2008 | Owaki | |
| 2005/0046668 | A1 * | 3/2005 | Owaki | 347/44 |
| 2008/0100664 | A1 | 5/2008 | Owaki | |

FOREIGN PATENT DOCUMENTS

| | | | | |
|---|---|---|---|---|
| JP | 02030541 | A * | 1/1990 | 29/890.1 |
| JP | 2002-160376 | A | 6/2002 | |
| JP | 3893936 | B2 | 5/2003 | |
| JP | 2006-051685 | A | 2/2006 | |
| JP | 2006-281604 | A | 10/2006 | |
| JP | 2006-326937 | A | 12/2006 | |
| JP | 2006-327024 | A | 12/2006 | |

* cited by examiner

*Primary Examiner* — A. Dexter Tugbang
(74) *Attorney, Agent, or Firm* — Sughrue Mion, PLLC

(57) ABSTRACT

An alignment method includes: disposing an alignment mark provided to a positioned member and a reference mark provided to a surface of an alignment mask so that the alignment mark and the reference mark can face each other; capturing an image from the other surface side of the alignment mask, which is the opposite surface of the alignment mask from the surface where the reference mark is disposed, the image concurrently showing the alignment mark and the reference mark; performing a surface treatment on at least a region of the positioned member side of the alignment mask, which is captured as the image, rather than on the reference mark side thereof, the surface treatment providing a high contrast ratio to each alignment mark and reference mark on the captured image; and thereafter aligning the alignment mark with the reference mark, while checking the image.

13 Claims, 12 Drawing Sheets

ALIGNMENT METHOD OF LIQUID-JET HEAD UNIT

The entire disclosure of Japanese Patent Application No. 2006-249860 filed Sep. 14, 2006 is expressly incorporated by reference herein.

BACKGROUND

1. Technical Field

The present invention relates to an alignment method in which an alignment mark of a to-be-positioned member (hereinafter referred to as a positioned member) is aligned with a reference mark provided to an alignment mask, and to an alignment mask used in the alignment method. The invention particularly relates to an alignment method of a liquid-jet head unit in which a liquid-jet head as a positioned member is fixed to a fixing plate.

2. Related Art

An ink-jet recording apparatus such as an ink-jet printer or a plotter is provided with an ink-jet recording head unit (hereinafter referred to as a head unit) which includes an ink-jet recording head to eject ink in the form of ink droplets. The ink is stored in a liquid storing portion such as an ink cartridge or an ink tank. The ink-jet recording head has nozzle lines each of which is made of nozzle orifices which are arranged side by side, and the ink-droplet-ejection surface is protected with a cover head. The cover head includes a window frame portion which has: an orifice window portion provided on an ink-droplet-ejection surface side of the ink-jet recording head to expose the nozzle orifices; and a side wall portion formed by bending the window frame portion to a side surface of the ink-jet recording head. The cover head is fixed by joining the side wall portions to the side surfaces of the ink-jet recording head (for example, see JP-A-2002-160376 (Page 9, FIG. 3)).

Furthermore, when fixing members, such as a cover head and a fixing plate, are joined to a plurality of ink-jet recording heads, the positioning of the ink-jet recording heads to a predetermined position is performed by moving the ink-jet recording heads to the fixing members so that an alignment mark, which is provided to a nozzle plate and which has the same shape as that of a nozzle orifice, can match a reference mark provided to an alignment mask formed of a flat glass plate.

In an alignment method of such a head unit, a reference mark provided to a transparent member, such as a glass, used as a mask member, and an alignment mark provided to a nozzle plate are imaged at the same time using an imaging means including a microscope and a CCD camera, so that an image is captured, whereby alignment is performed while checking the image thus captured. However, since the alignment mark is formed of a penetrated hole having the same shape as that of a nozzle orifice as described above, the alignment mark is imaged in a black color in the image captured by the imaging means. At this time, since the alignment mark is black, the reference mark is imaged in white to increase the contrast ratio to the alignment mark. Furthermore, the background of the image captured by the imaging means is shown in a whitish color close to a white color due to light reflected on the surface of the nozzle plate.

Here, suppose a case where image processing is performed on the captured image to detect the boundaries between the alignment mark and the background and between the reference mark and the background. In this case, since the contrast ratio between the whitish background being close to a white color and the blackish alignment mark is high, the boundary of the blackish alignment mark can be detected with high accuracy. However, since the transparent member such a glass is used for the alignment mask, the background color of the nozzle plate is imaged through the alignment mask using the imaging means, so that the contrast ratio is low between the background close to a color white, and the whitish reference mark. Accordingly, unevenness occurs on the boundary of the reference mark. Consequently, the boundary of the reference mark cannot be detected with high accuracy, and a decrease in alignment accuracy comes up as a problem.

Note that, such a problem exists not only in the alignment method of a liquid-jet head unit such as an ink-jet recording head unit, but also in an alignment method in which an alignment mark of a positioned member is aligned with a reference mark provided to an alignment mask.

SUMMARY

An advantage of some aspects of the invention is to provide: an alignment method in which the boundaries of an alignment mark and a reference mark can be detected with high accuracy so that alignment accuracy can be enhanced; an alignment method of a liquid-jet head unit; and an alignment mask.

An aspect of the invention provides an alignment method. In the method, an alignment mark provided to a positioned member and a reference mark provided to a surface of an alignment mask are disposed so that the alignment mark and the reference mark can face each other. Then, an image is captured from the other surface side of the alignment mask, which is the opposite surface of the alignment mask from the surface where the reference mark is disposed. The image concurrently shows the alignment mark and the reference mark. Subsequently, a surface treatment is performed on at least a region of the positioned member side of the alignment mask rather than on the reference mark side thereof. The region is captured as the image. The surface treatment is performed to provide a high contrast ratio to each of the alignment marks and the reference marks on the captured image. Thereafter, the alignment marks are aligned with the reference marks while checking the image.

According to this aspect, by performing the surface treatment on the alignment mask, the contrast ratios of the background to the reference mark and the alignment mark can be increased in the image captured by an imaging means. As a result, the boundary between the reference mark and the background, and the boundary between the alignment mark and the background can be detected with high accuracy.

In this respect, it is preferable that the alignment mark be shown in one of blackish and whitish colors, and the reference mark be shown in the other of the blackish and whitish colors different from the one shown as the alignment mark. Accordingly, in the image captured by the imaging means, the contrast ratios of the backgrounds to the reference mark in one of the blackish and whitish colors and to the alignment mark in the other thereof can be increased. Thus, the boundary between the reference mark and the background and the boundary between the alignment mark and the background can be detected with high accuracy.

In addition, it is preferable that the surface treatment be to form a thin film on the positioned member side of the alignment mask rather than on the reference mark side thereof.

Accordingly, by performing the surface treatment to form the thin film, the contrast ratio to each alignment mark and reference mark can be easily increased.

Moreover, it is preferable that the thin film be formed of a metallic film.

Accordingly, by performing the surface treatment to form a metallic film, the contrast ratio to each of the alignment marks and the reference marks can be easily increased.

Furthermore, it is preferable that the thin film be formed by a sputtering method.

Accordingly, a metallic film can be easily formed to have a desired thickness, and the contrast ratio can be easily adjusted.

Additionally, it is preferable that the surface treatment be a colored film adhered to the positioned member side of the alignment mask rather than to the reference mark side thereof.

Accordingly, by performing the surface treatment to paste the colored film, the contrast ratio to each alignment mark and reference mark can be easily increased.

Moreover, it is preferable that the surface treatment be to a blast process performed on the positioned member side of the alignment mask rather than on the reference mark side thereof.

Accordingly, by performing such a surface treatment as the blast process, the contrast ratio to each alignment mark and reference mark can be easily increased.

Furthermore, it is preferable that the surface treatment be performed on the entire surface of the positioned member side of the alignment mask, including the alignment mark, rather than on the reference mark side thereof.

Accordingly, since the reference mark is imaged from the other surface side of the alignment mask, the surface-treated surface does not intervene when the reference mark is imaged, so that the contrast ratio to the reference mark is not reduced. Furthermore, by performing the surface treatment on the entire surface of the alignment mask, processes such as masking and patterning can be eliminated at a time of the surface treatment. As a result, the production cost can be reduced.

Additionally, it is preferable that the reference mark have an annular shape, and that the alignment mark have a smaller outer diameter than an inner diameter of the reference mark.

Accordingly, the alignment mark can be easily aligned with the annular reference mark. The alignment of the alignment mark can be adjusted using the gap between the reference mark and the alignment mark. Therefore, alignment can be achieved with high accuracy.

Moreover, it is preferable that the surface treatment be performed so that the contrast ratio to each reference mark and the alignment mark can be high on the inside of the reference mark, and so that the contrast ratio to the reference mark can be higher on the outside of the reference mark than on the inside of the reference mark.

Accordingly, the contrast ratio of the background on the outside of the reference mark is set to be higher than that of the background on the inside thereof, whereby the contrast ratio between the reference mark and the background on the outside thereof is increased. As a result, the reference mark can be easily found.

Furthermore, it is preferable that the surface treatment be performed so that the contrast ratio to each reference mark and alignment mark can be high on the inside of the reference mark, and so that the contrast ratio to the reference mark can be lower on the outside of the reference mark than on the inside of the reference mark.

Accordingly, the contrast ratio of the background on the outside of the reference mark is set to be lower than that of the background on the inside thereof, whereby the contrast ratio between the reference mark on the outside and the alignment mark can be set high. Thus, when the alignment mark exists outside the reference mark, the alignment mark can be easily found.

Another aspect of the invention provides an alignment method of a liquid-jet head unit. In this method, by the alignment method according to the above-described aspect, the positioned member is aligned with a fixing member. The positioned member includes: a nozzle plate provided with a nozzle orifice to eject liquid; and a liquid-jet head in which the alignment mark is provided to the nozzle plate. The fixing member holds a plurality of liquid-jet heads.

Accordingly aspect, since the alignment of the liquid-jet head and the fixing member can be performed with high accuracy, it is possible to fabricate a liquid-jet head unit in which a liquid jet property is enhanced.

In this respect, it is preferable that the alignment mark have the same shape as that of the nozzle orifice provided to the nozzle plate.

Accordingly, the alignment mark can be imaged in a blackish color, and the alignment mark can be formed along with the nozzle orifice, so that the alignment mark can be easily formed with high accuracy.

Still another aspect of the invention provides an alignment mask. The alignment mask includes: a reference mark which is provided to a mask body, and which is disposed to face an alignment mark provided to a positioned member; and a region which is located on the positioned member side of the mask body, rather than on the reference mark side thereof, and on which a surface treatment is performed. The alignment mask is used in aligning the alignment mark with the reference mark by checking an image that is captured so as to show concurrently the alignment mark, the reference mark, and the region on which the surface treatment is performed on. The surface treatment gives the region a high contrast ratio to each alignment mark and reference mark in the captured image.

Accordingly to this aspect, by performing the surface treatment on the alignment mask, the contrast ratio of the background to each reference mark in one of blackish and whitish colors, and to each alignment mark in the other thereof can be increased in the image captured by the imaging means. Thus, the boundary between the reference mark and the background and the boundary between the alignment mark and the background can be detected with high accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail referring to embodiments.

First Embodiment

Prior to a description of an alignment mask for a liquid-jet head unit according to a first embodiment of the invention, a description will be given of an example of an ink-jet recording head unit which is an example of a liquid-jet head unit being an object of the alignment.

Figure 1:
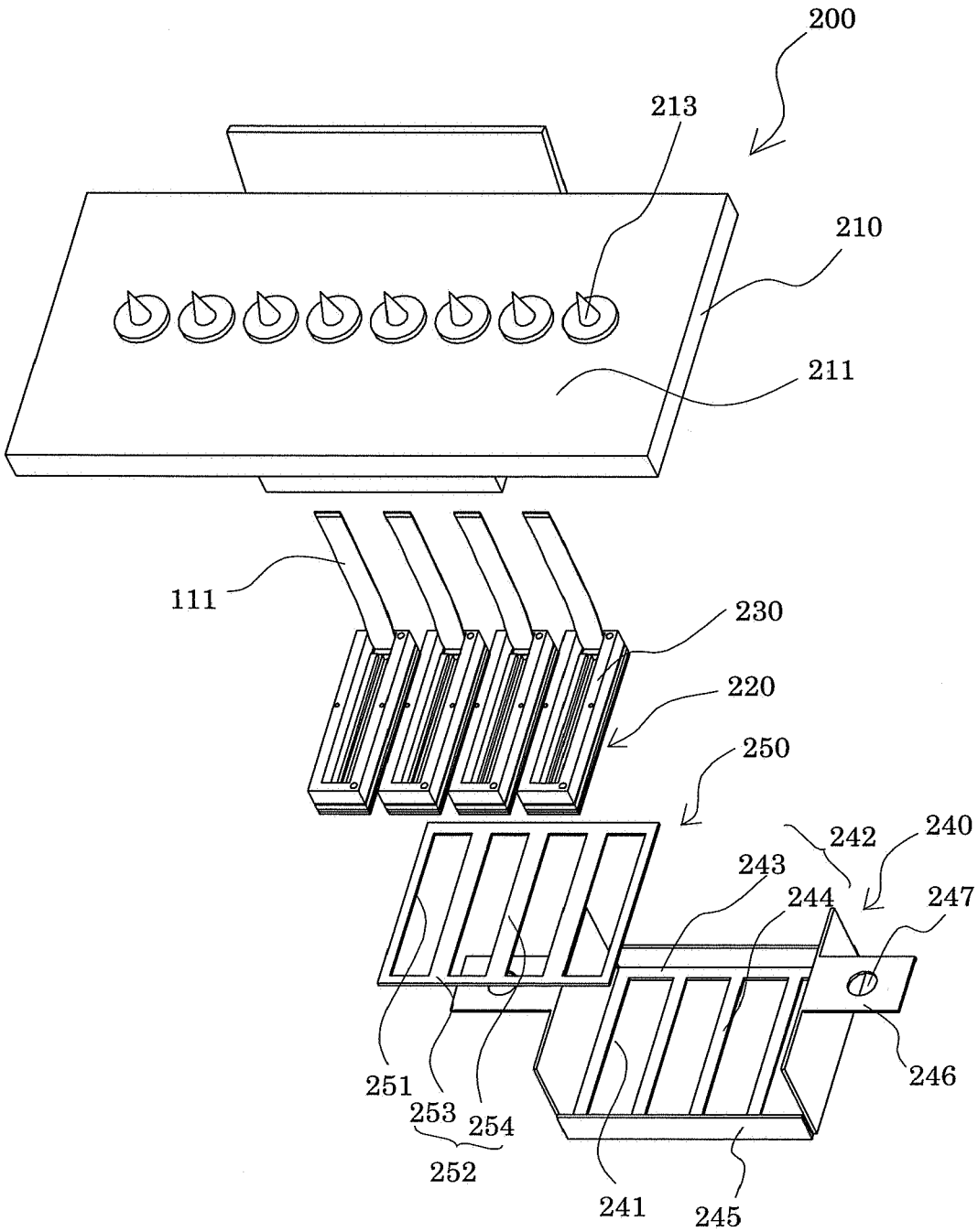
FIG. 1 is an exploded perspective view of a head unit according to a first embodiment.
Figure 2:
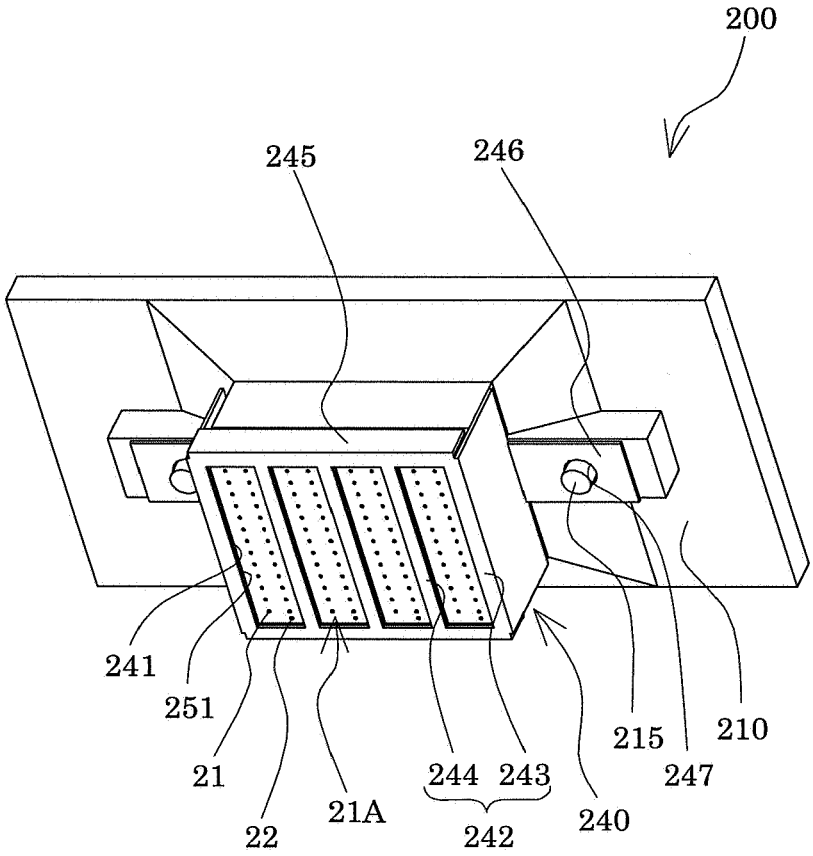
FIG. 2 is a perspective view showing the assembled head unit according to the first embodiment.
Figure 3:
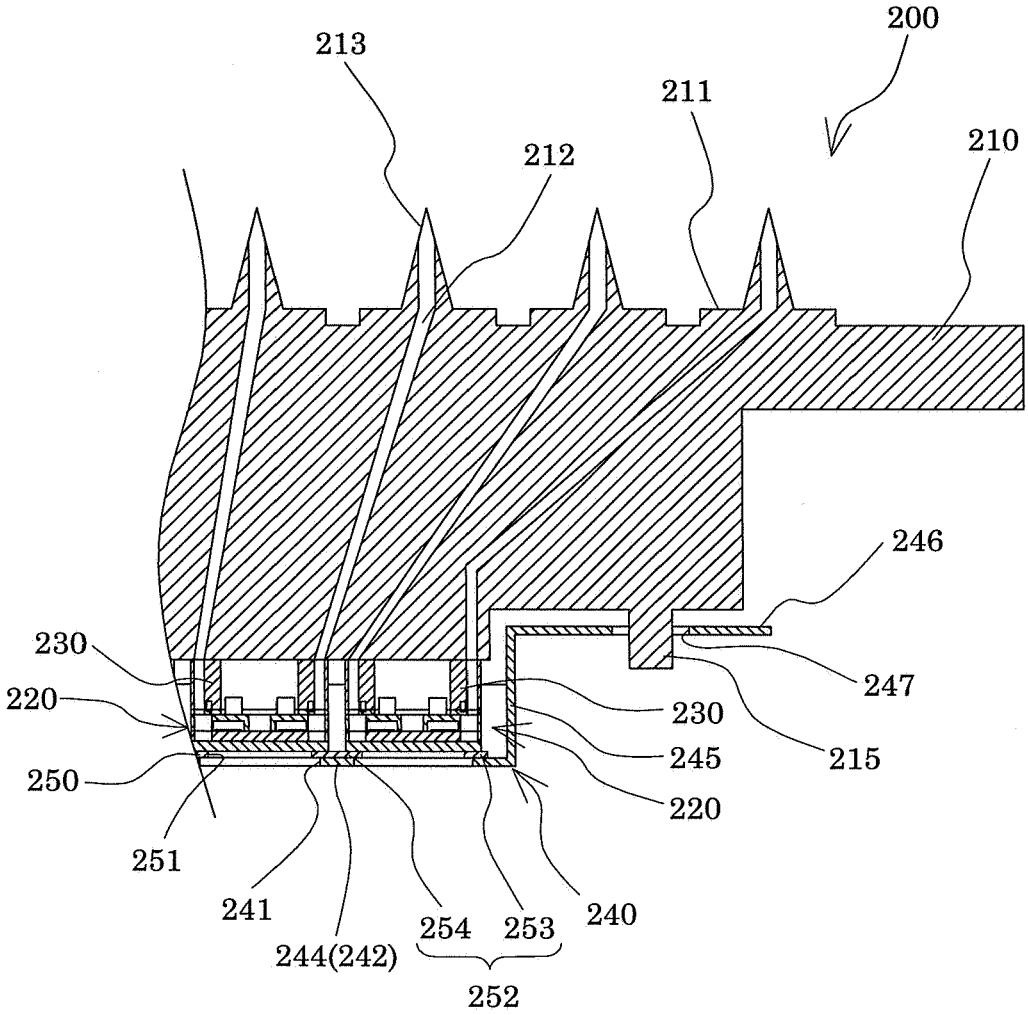
FIG. 3 is a cross-sectional view showing a principal part of the head unit according to the first embodiment.

FIG. 1 is an exploded perspective view showing an ink-jet recording head unit, which is an example of a liquid-jet head unit according to the first embodiment of the invention. FIG. 2 is a perspective view showing the assembled ink-jet recording head unit. FIG. 3 is a cross-sectional view showing a principal part of the ink-jet recording head unit. As shown in FIG. 1, a cartridge case 210 is a holding member which constitutes an ink-jet recording head unit 200 (hereinafter referred to as a head unit 200) being an example of the liquid-jet head unit. The cartridge case 210 includes cartridge mounting portions 211 on which ink cartridges (not shown) being ink supply means (liquid supply means) are mounted. For example, in this embodiment, the ink cartridges are constituted of separate bodies which are respectively filled with inks of a black color and three different colors. The ink cartridges for the respective colors are mounted on the cartridge case 210. Moreover, as shown in FIG. 3, the bottom surface of the cartridge case 210 is provided with a plurality of ink communicating paths 212, one of each of the ends thereof being open at the respective cartridge mounting portions 211, and the other ends thereof being open on a head case 230 side to be described later. In addition, ink supply needles 213 are inserted into ink supply ports of the ink cartridges, and are fixed to opening portions of the ink communicating paths 212 at the cartridge mounting portions 211 with filters (not shown) interposed between the opening portions and the ink supply needles 213. The filters are formed on the ink communicating paths 212 to remove air bubbles and foreign substances in inks.

Furthermore, on the bottom surface of the cartridge case 210, a plurality of piezoelectric elements 300 and the head cases 230 are provided. An ink-jet recording head 220 is fixed to an end surface of the head case 230, the end surface being on the opposite side to the cartridge case 210. The ink-jet recording head 220 ejects ink droplets through nozzle orifices 21 by the driving of the piezoelectric elements 300. In this embodiment, the plurality of ink-jet recording heads 220 are provided for the respective colors, and eject the respective color inks in the ink cartridges. The plurality of head cases 230 are also provided independently to one another, and correspond to the ink-jet recording heads 220, respectively.

Figure 4:
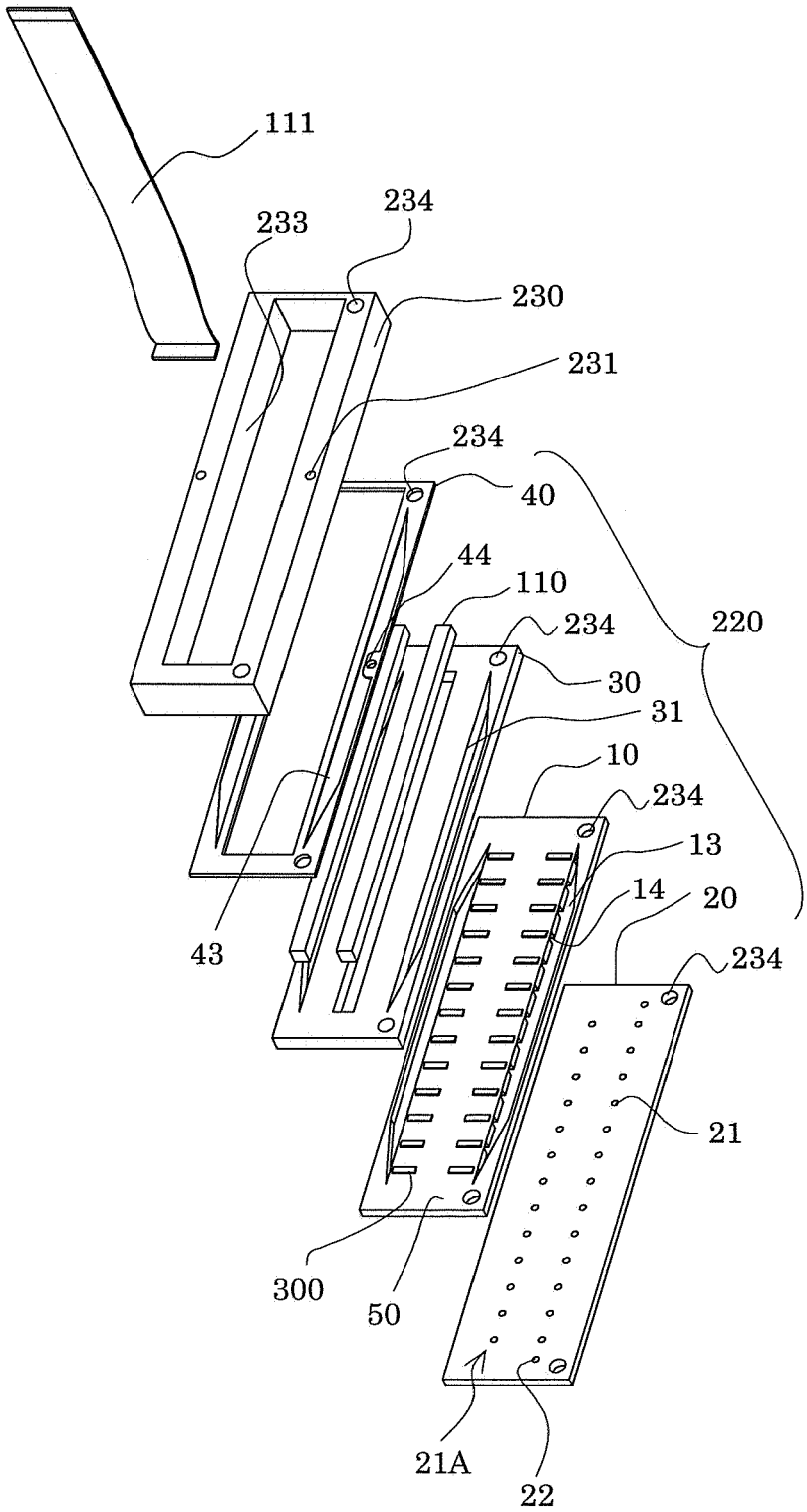
FIG. 4 is an exploded perspective view showing principal parts of the head unit according to the first embodiment.
Figure 5:
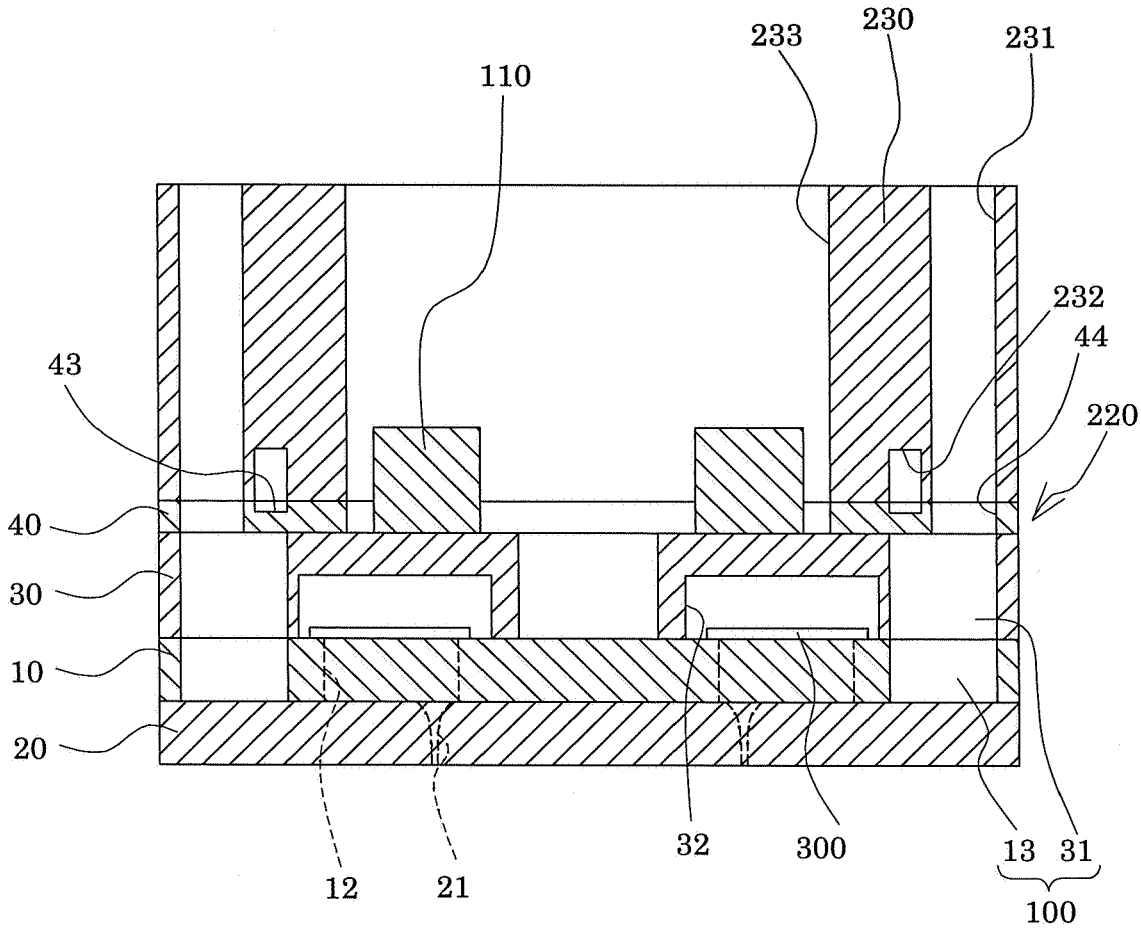
FIG. 5 is a cross-sectional view showing a recording head and a head case according to the first embodiment.

Hereinafter, description will be given of the ink-jet recording head 220 being an example of the liquid-jet head in this embodiment, as well as the head case 230, which are mounted on the cartridge case 210. FIG. 4 is an exploded perspective view showing principal parts of the ink-jet recording head 220 and the head case 230. FIG. 5 is a cross-sectional view showing the ink-jet recording head 220 and the head case 230. As shown in FIGS. 4 and 5, a passage-forming substrate 10, which constitutes the ink-jet recording head 220, is formed of a single crystal silicon substrate in this embodiment. On one surface of the passage-forming substrate 10, an elastic film 50 made of silicon dioxide is formed, and the elastic film 50 is made of silicon dioxide formed by means of thermal oxidation in advance. An anisotropic etching is performed from the other surface of the passage-forming substrate 10 to form pressure-generating chambers 12 in two lines which are parallel to each other in the width direction thereof. The pressure-generating chambers 12 are partitioned with a plurality of compartment walls. In addition, a communicating portion 13 is formed on the outside of and in the longitudinal direction of each line of the pressure-generating chambers 12. The communicating portion 13 communicates with a reservoir portion 31 provided to a protective plate 30 to be described later, and thus constitutes a reservoir 100 serving as a common ink chamber for each pressure-generating chamber 12. The communicating portion 13 communicates with one end of each pressure-generating chamber 12 in the longitudinal direction thereof via an ink supply path 14.

Moreover, a nozzle plate 20, in which the nozzle orifices 21 are drilled, is fixed to the opening surface side of the passage-forming substrate 10 with an adhesive agent, a thermal adhesive film or the like. Each nozzle orifice 21 communicates with the corresponding pressure-generating chamber 12, on the opposite side to the ink supply paths 14. In other words, in this embodiment, for one ink-jet recording head 220, two nozzle lines 21A are provided. In the nozzle lines 21A, the nozzle orifices 21 are arranged side by side. Note that, the nozzle plate 20 is made of a glass ceramic material, a single-crystal silicon substrate, stainless steel or the like, which has a thickness of, for example, 0.01 mm to 1 mm, a linear expansion coefficient of, for example, 2.5 to 4.5 ($\times 10^{-6}$/° C.) at a temperature of 300° C. or less. Furthermore, alignment marks 22 used for aligning with a fixing plate 250 to be described later in detail, are provided to the nozzle plate 20. In this embodiment, as the alignment mark 22, two penetrated holes, each having an opening with the same circular shape as that of the nozzle orifice 21, are provided on the outside of the nozzle orifices 21 in a direction in which the nozzle orifices 21 are arranged side by side. In this manner, by providing the alignment marks 22 having the same shape as that of the nozzle orifice 21, when the nozzle orifices 21 are formed in the nozzle plate 20 made of stainless steel by using a punch, the alignment marks 22 can be simultaneously formed at the same pitches as those for the nozzle orifices 21.

Meanwhile, the piezoelectric element 300 is formed on the elastic film 50, on the opposite side to the opening surface, of the passage-forming substrate 10. The piezoelectric element 300 is formed by sequentially stacking a lower electrode film made of a metal, a piezoelectric layer made of lead zirconate titanate (PZT) or the like, and an upper electrode film made of a metal. The protective plate 30 is bonded to the top of the passage-forming substrate 10 on which the piezoelectric elements 300 are formed. The protective plate 30 includes the reservoir portion 31, which constitutes at least apart of the reservoir 100. In this embodiment, the reservoir portion 31 is formed in a manner of penetrating the protective plate 30 in the thickness direction thereof, and extending in the width direction of the pressure-generating chambers 12. As described above, the reservoir portion 31 communicates with the communicating portion 13 of the passage-forming substrate 10 to constitute the reservoir 100, which serves as the common ink chamber for the pressure-generating chambers 12.

In addition, a piezoelectric element holding portion 32 is formed in a region, facing the piezoelectric elements 300, of the protective plate 30. The piezoelectric element holding portion 32 has space large enough to allow the piezoelectric elements 300 to operate. The material of the protective plate 30 can include glass, ceramic, metal, plastic, and the like. However, preferably used is a material having substantially the same thermal expansion coefficient as that of the passage-forming substrate 10. In this embodiment, the protective plate 30 is made of the single-crystal silicon substrate which is the same material as that of the passage-forming substrate 10.

Moreover, a drive IC 110, which drives the piezoelectric elements 300, is provided on the protective plate 30. Terminals of this drive IC 110 are connected to extension wirings, which are extended from individual electrodes of the piezoelectric elements 300 through bonding wires (not shown) or the like. The terminals of the drive IC 110 are connected to the outside through external wirings 111 such as flexible print cables (FPC) as shown in FIG. 1, and receive various signals such as print signals through the external wirings 111 from the outside.

Furthermore, a compliance plate 40 is joined onto the protective plate 30. In a region, facing the reservoir 100, of the compliance plate 40, an ink introducing port 44 for supplying the reservoir 100 with inks is formed by penetrating the compliance plate 40 in the thickness direction thereof. In addition, a region other than the ink introducing port 44 in the region facing the reservoir 100 of the compliance 40 is a flexible portion 43, which is formed to have a small thickness in the thickness direction. The reservoir 100 is sealed with the flexible portion 43. The flexible portion 43 gives compliance to the inside of the reservoir 100.

The ink-jet recording head 220 of this embodiment as described above includes four plates: the nozzle plate 20, the passage-forming substrate 20, the protective plate 30, and the compliance plate 40. On the compliance plate 40 of the ink-jet recording head 220, the head case 230 in which ink supply communicating paths 231 are formed is provided. The ink supply communicating path 231 communicates with the ink introducing port 44 and concurrently with the ink communicating path 212, and supplies the ink introducing port 44 with inks from the cartridge case 210. On the head case 30, a recessed portion 232 is formed on a region, facing the flexible portion 43 of the head case 230, so that the flexible portion 43 is allowed to flexurally deform as needed. In addition, to the head case 230, a drive IC holding portion 233 is provided. The drive IC holding portion 233 penetrates, in the thickness direction thereof, a region of the head case 230 facing the drive IC 110 which is provided on the protective plate 30. The external wiring 111 is inserted into the drive IC holding portion 233, and connected to the drive IC 110.

The ink-jet recording head 220 of this embodiment takes in inks from the ink cartridge, through the ink introducing port 44 via the ink communicating paths 212 and the ink supply communicating paths 231. After the insides from the reservoirs 100 to the nozzle orifices 21 are all filled with inks, the ink-jet recording head 220 applies a voltage to each piezoelectric element 300 corresponding to the pressure-generating chamber 12 in accordance with a recording signal from the drive IC 110. As a result, the elastic film 50 and the piezoelectric elements 300 are flexurally deformed thereby to increase the pressure in each pressure-generating chamber 12, and thus ink droplets are ejected through the nozzle orifices 21.

Furthermore, pin insertion holes 234 are provided at two corners of the head case 230 and each member constituting the ink-jet recording head 220. Pins for positioning the members at the time of assembly are inserted into the pin insertion holes 234. The pins are inserted into the pin insertion holes 234 of the members, and the members are joined while being relatively positioned. Thus, the ink-jet recording head 220 and the head case 230 are integrally formed.

Incidentally, the ink-jet recording head 220 described above is formed as follows. A number of chips are simultaneously formed on one silicon wafer. The nozzle plate 20 and the compliance plate 40 are bonded thereto so as to be integrated, and thereafter divided for every passage-forming substrate 10 of one chip size as shown in FIG. 4. Thus, an ink-jet recording head 220 is formed.

Four sets of the ink-jet recording heads 220 and the head cases 230 are fixed to the cartridge case 210 at predetermined intervals in the arrangement direction of the nozzle line 21A. In other words, in the head unit 200 of this embodiment, eight nozzle lines 21A are provided. The use of the plurality of ink-jet recording heads 220 described above to increase the number of the nozzle lines 21A formed of the nozzle orifices 21, which are arranged side by side, makes it possible to prevent the reduction in yield compared with the use of the single ink-jet recording head 220 with a number of the nozzle lines 21A formed therein. In addition, the use of the plurality of the ink-jet recording heads 220 to increase the number of the nozzle lines 21A makes it possible to increases the number of the ink-jet recording heads 220 to be produced from one silicon wafer, thus to maximally use the area of silicon wafer, and consequently to reduce the production cost.

Furthermore, as shown in FIGS. 1 and 3, these four ink-jet recording heads 220 are positioned and held by the fixing plate 250 being a common fixing member which is joined to a plurality of ink-droplet-ejection surfaces of the ink-jet recording heads 220. The fixing plate 250 is formed of a flat plate, and includes: an exposure opening portion 251 for exposing the nozzle orifices 21; and a joining portion 252 which partitions the exposure opening portion 251 and which is joined to at least both end sides of the nozzle lines 21A of the ink-droplet-ejection surfaces of the ink-jet recording heads 220.

In this embodiment, the joining portion 252 includes: a fixing frame portion 253, which is provided along the outer periphery of the ink-droplet-ejection surfaces over the plurality of ink-jet recording heads 220; and fixing beam portions 254 which are provided between and extended along the neighboring ink-jet recording heads 220, and which divide the exposure opening portions 251. The joining portion 252 constituted of the fixing frame portion 253 and the fixing beam portions 254 is concurrently joined to the plurality of ink-droplet-ejection surfaces of the ink-jet recording heads 220. In addition, the fixing frame portion 253 of the joining portion 252 is formed so that the fixing frame portion 253 can seal the pin insertion holes 234 used for positioning each member at the time of producing the ink-jet recording heads 220.

As the material of this fixing plate 250 can include, for example, a metal such as stainless steel, a glass ceramic or a single-crystal silicon substrate. In addition, as the material of the fixing plate 250, it is preferable to use a material having the same thermal expansion coefficient as that of the nozzle plate 20 in order to avoid the deformation which occurs due to the difference in thermal expansion from that of the nozzle plate 20. For example, when the nozzle plate 20 is formed of a single-crystal silicon substrate, it is preferable that the fixing plate 250 be also formed of the single-crystal silicon substrate.

Moreover, it is preferable that the fixing plate 250 be formed to have a small thickness, and be thinner than a cover head 240 to be described later. This is because, for example, when the fixing plate 250 has a large thickness, the distance between the alignment mark 22 and a reference mark of a liquid-jet head alignment (hereinafter referred to as an alignment mask) is long. For this reason, it is difficult to increase the alignment accuracy, and inks tend to remain in the fixing beam portions 254 or in a similar place after wiping the ink-droplet-ejection surface of the nozzle plate 20. The alignment mark 22 is provided to the nozzle plate 20 of the ink-jet recording head 220, which is described in detail later, while the reference mark is used for aligning with the fixing plate 250. In other words, by forming the fixing plate 250 to have a small thickness, the distance between the alignment mark 22 of the ink-jet recording head 220 and the reference mark of the alignment mask is made short. Thus, the alignment can be easily performed with high accuracy, and at the time of the wiping, inks can be prevented from remaining on the ink-droplet-ejection surface of the nozzle plate 20. Note that, in this embodiment, the fixing plate 250 has a thickness of 0.1 mm. While the way of joining the fixing plate 250 to the nozzle plate 20 is not particularly limited, the fixing plate 250 and the nozzle plate 20 may be joined by means of bonding using, for example, a thermosetting epoxy adhesive agent or an ultraviolet curing adhesive agent.

As described above, since the fixing plate 250 seals a space between the neighboring ink-jet recording heads 220 with the fixing beam portions 254, inks does not enter the space between the neighboring ink-jet recording heads 220. Thus, the piezoelectric element 300, the drive IC 110, and the like can be prevented from deteriorating or damage due to inks in the ink-jet recording heads 220. Moreover, since the ink-droplet-ejection surfaces of the ink-jet recording heads 220 and the fixing plate 250 are bonded with no gap using an adhesive agent, a recorded medium is prevented from entering the gap therebetween, which might have existed otherwise. Thus, the deformation of the fixing plate 250 and paper jam can be prevented.

Figure 6A:
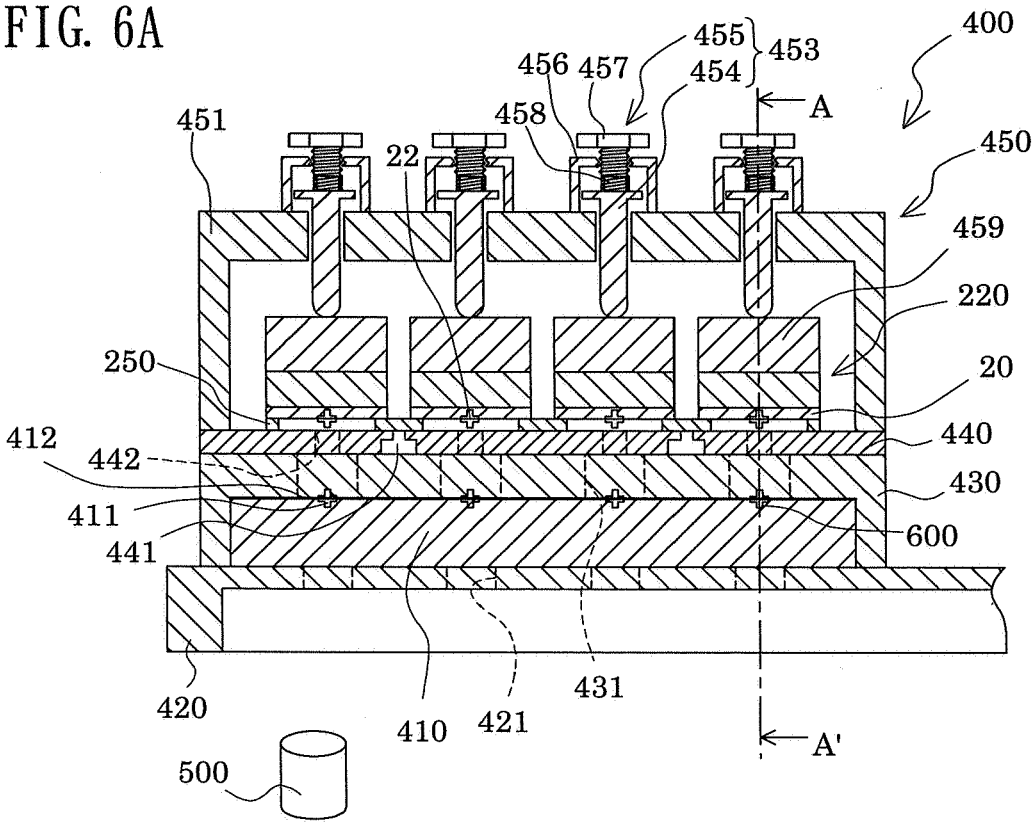
FIGS. 6A and 6B are cross-sectional views of an alignment apparatus according to the first embodiment.
Figure 6B:
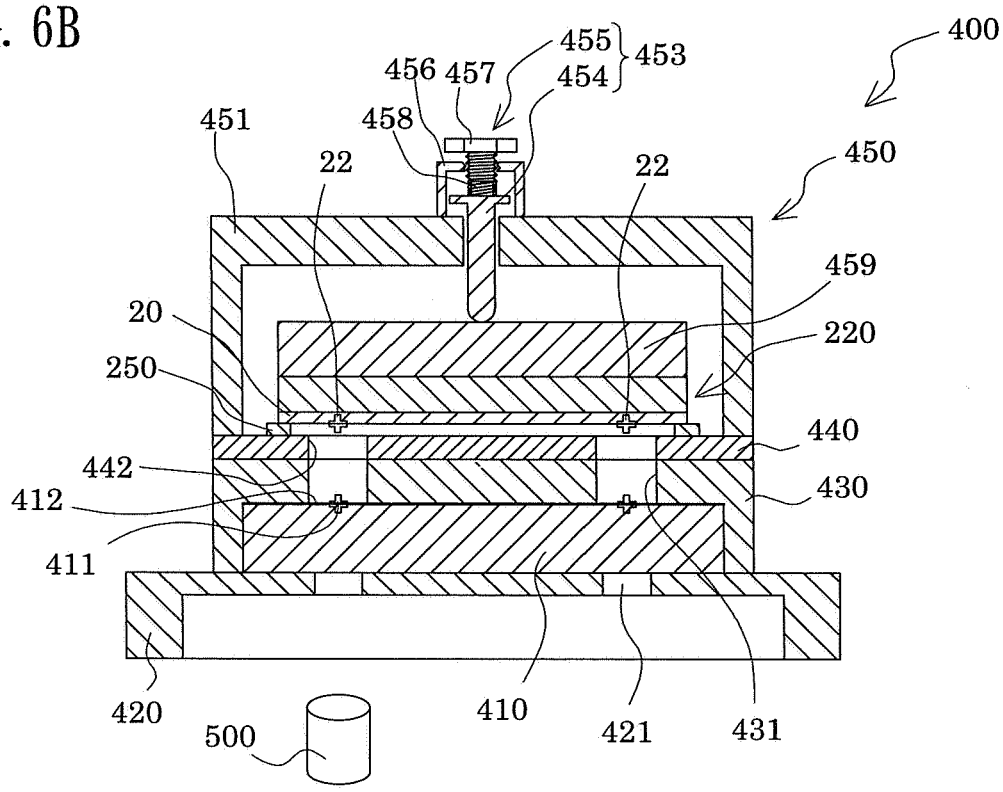
Figure 7A:
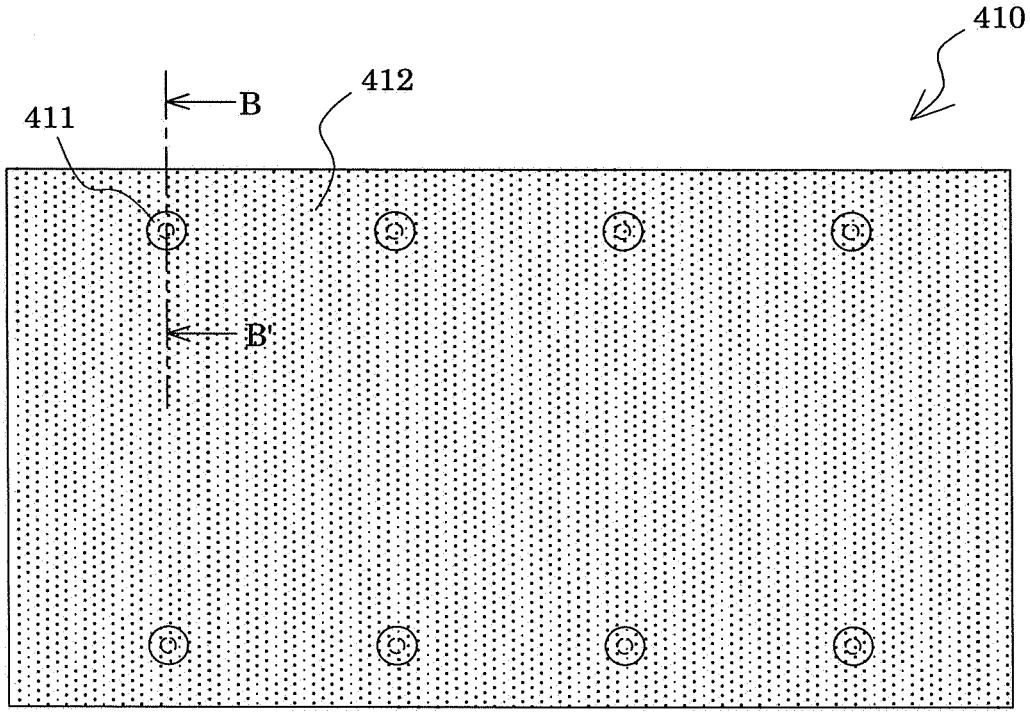
FIGS. 7A and 7B are respectively a plan view and a cross-sectional view of an alignment mask according to the first embodiment.
Figure 7B:
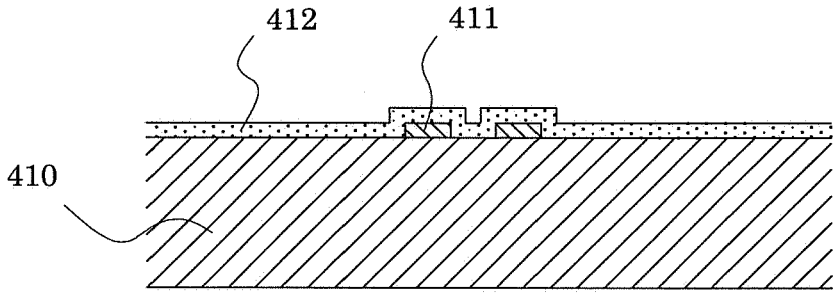

In addition, the four ink-jet recording heads 220 are aligned with and fixed to the fixing plate 250. The alignment of the ink-jet recording heads 220 with the fixing plate 250 can be performed using an alignment apparatus having the alignment mask. Hereinafter, the alignment apparatus having the alignment mask will be described in detail. FIG. 6A is a cross-sectional view of the alignment apparatus, and FIG. 6B is a cross-sectional view taken along the line A-A' in FIG. 6A. FIG. 7A is a plan view of the alignment mask, and FIG. 7B is a cross-sectional view taken along the line B-B' in FIG. 7A.

As shown in FIGS. 6A and 6B, an alignment apparatus 400 includes an alignment mask 410, a holding table 420, a base jig 430, a spacer jig 440, and imaging means 500. The alignment mask 410 is provided with a reference mark 411 on the upper surface thereof, and the ink-jet recording head 220, being a positioned member, is aligned with the reference mark 411. The holding table 420 holds the bottom surface of the alignment mask 410. The base jig 430 is provided on the upper surface of the alignment mask 410. The spacer jig 440 is provided on the base jig 430, and holds the fixing plate 250 being the fixing member of the head unit. The imaging means 500 is provided on the holding table 420 on the opposite side to the alignment mask 410, and includes a microscope and a CCD camera having an optical system to check the reference marks 411 of the alignment mask 410 and the alignment marks 22 of the nozzle plates 20.

According to the alignment apparatus 400, the fixing plate 250 is held on the base jig 430 with the spacer jig 440 interposed therebetween. Then, the two alignment marks 22, which are provided to the nozzle plate 20 of the ink-jet recording head 220, are aligned with the reference marks 411 of the alignment mask 410. Accordingly, the plurality of nozzle plates 20 of the ink-jet recording heads 220 and the fixing plate 250 are bonded using the adhesive agent, with the plurality of ink-jet recording heads 220 being relatively aligned.

To be more specific, the alignment mask 410 is made of a transparent member such as glass. As shown in FIGS. 7A and 7B, the upper surface of the alignment mask 410 is provided with the reference marks 411 with which the alignment marks 22 of the ink-jet recording heads 220 are respectively aligned. In this embodiment, since the four ink-jet recording heads 220 are fixed to the fixing plate 250, the eight reference marks 411 are provided to the alignment mask 410. It is needless to say that the number of the reference marks 411 is not particularly limited to this, and the reference marks 411 may be suitably provided in accordance with the number of the ink-jet recording heads 220 which is mounted on the head unit 200, i.e., the number of the ink-jet recording heads 220 which are fixed to the fixing plate 250.

The reference marks 411 are aligned with the alignment marks 22 each having the same shape as that of the nozzle orifice 21 with a circular opening. The reference mark 411 has an annular shape so that the reference mark 411 is provided with therein a single hole, the inner diameter of which is larger than the outer diameter of the alignment mark 22. The alignment marks 22 are aligned with the single holes of the reference marks 411 with predetermined intervals, so that the ink-jet recording heads 220 can be aligned with the alignment mask 410.

Incidentally, the reference marks 411 can be formed by screen-printing, for example, a metal. In addition, these reference marks 411 are imaged using the imaging means 500 concurrently with the alignment marks 22, while being described in detail later. At this time, since the reference marks 411 are made of the metal, these reference marks 411 are shown in a white (whitish) color in the image, due to the reflection of light at the time of imaging using the imaging means 500. Moreover, since the alignment marks 22 are formed of the penetrated holes having the same shape as that of the nozzle orifice 21, the light at the time of imaging using the imaging means 500 is not reflected, and thereby the alignment marks 22 are shown in a black (blackish) color in the image. Note that, by reversing the color with image processing, the reference marks 411 can be shown in a black (blackish) color, while the alignment marks 22 can be shown in a white (whitish) color. For this reason, it is only necessary that the reference marks 411 be shown in one of blackish and whitish colors in the image captured by the imaging means 500, and that the alignment marks 22 be shown in the other of blackish and whitish colors.

Furthermore, a surface treatment is performed on the surface of the alignment mask 410 on which the reference marks 411 are provided. In other words, the surface of the alignment mask 410 on the nozzle plate 20 side rather than on the reference marks 411 side is provided with a surface treatment film 412 to be described in detail later. In this embodiment, the surface treatment film 412 formed of a thin metallic film is provided over the entire surface of the alignment mask 410 including the surface over the reference marks 411 provided thereon. The surface treatment film 412 can be formed with a sputtering method, a vapor deposition method, or the like. Incidentally, the surface treatment film 412 is not limited to a thin metallic film, and may be, for example, a resin film.

In this manner, the surface treatment is performed on the surface of the alignment mask 410 on which the reference marks 411 are provided. For this reason, when the alignment marks 22 and the reference marks 411 are concurrently imaged using the imaging means 500, in the image thus captured, the reference marks 411 are shown in a white (whitish) color, and the alignment marks 22 are shown in a black (blackish) color. The surface treatment film 412 is shown as the background in a gray color, having a high contrast ratio to each black alignment mark 22 and white reference mark 411. In other words, the thickness, the material, and the like of the surface treatment film 412 can be suitably determined so that the surface treatment film 412 can be imaged in a color having a high contrast ratio to each of the blackish alignment mark 22 and the whitish reference mark 411 in the image captured by the imaging means 500. For example, when the surface treatment film 412 and the reference mark 411 are formed to have the same thickness, the light from the imaging means 500 is reflected on the surface treatment film 412 so that the surface treatment film 412 is shown in a color close to a white color. As a result, problems arise that it is difficult to detect the boundary between the reference mark 41 and the background, and that the alignment mark 22 cannot be imaged through the background. Therefore, it is preferable that, for example, the surface treatment film 412 be formed to have a thickness smaller than that of the reference mark 411.

Furthermore, in this embodiment, the surface treatment film 412 is provided over the entire surface of the aliment mask 411 including the surface over the reference marks 411. Nevertheless, the alignment mask 410 is imaged by the imaging means 500 from the bottom side of the alignment mask 410, which is the opposite side to the upper surface thereof on which the reference marks 411 are provided. Moreover, the surface treatment film 412 is provided on the reference marks 411. Accordingly, the surface treatment film 412 does not intervene in the imaging of the reference marks 411. In addition, since the alignment mark 22 is formed to be black (blackish), even when the alignment mark 22 is imaged by the imaging means 500 with the surface treatment film 412 interposed therebetween, the color of the alignment mark 22 is unchanged.

In this manner, by performing the surface treatment on the surface of the alignment mask 410 on which the reference marks 411 are provided, the black (blackish) alignment mark 22, the white (whitish) reference marks 411, and the background formed from the surface treatment film 412 having a high contrast ratio to each of these marks 22 and 411, are shown in the image captured by the imaging means 500. Thus, the image processing enables highly accurate detection on the boundary between the alignment mark 22 and the background, and also on the boundary between the reference mark 411 and the background. Therefore, the alignment marks 22 can be aligned with the reference marks 411 with high accuracy.

Meanwhile, the holding table 420 of the alignment apparatus 400 holds the alignment mask 410 from the bottom surface thereof, which is the opposite side to the upper surface on which the reference marks 411 are provided. In addition, in this embodiment, the holding table 420 is movable relative to the apparatus body (not shown) along the surface direction (in the direction perpendicular to the optical axis of the imaging means 500) in which the alignment mask 410 is held. Moreover, penetrated holes 421, which penetrate the holding table 420 in the thickness direction thereof, are provided to the holding table 420 on regions facing the reference marks 411 of the alignment mask 410. This ensures light paths of the imaging means 500 to the alignment marks 22 via the reference marks 411.

The base jig 430 is fixed to the surface of the holding table 420 on which the alignment mask 410 is held. The base jig 430 is formed of stainless steel or the like, and has a box-like shape whose bottom is opened, so that the base jig 430 covers the alignment mask 410. Moreover, penetrated holes 431, which penetrate the base jig 430 in the thickness direction thereof, are provided to the base jig 430 on regions facing the reference marks 411 of the alignment mask 410. This ensures the light paths of the imaging means 500 to the alignment marks 22 via the reference marks 411.

The spacer jig 440 is held on the surface of the base jig 430, the surface being the opposite side to the alignment mask 410. The spacer jig 440 holds fixing plate 250. Specifically, the spacer jig 440 is formed of a plate-like member such as stainless steel, and the inside thereof is provided with a plurality of suction chambers 441, to which suction means (not shown) such as vacuum pumps are connected. The suction chambers 441 are open at the top surface of the spacer jig 440, and hold the fixing plate 250 by suctioning the surfaces thereof. In addition, the spacer jig 440 is provided with communicating holes 442 which communicate with the penetrated holes 431 of the base jig 430, and ensures that the light paths of the imaging means 500 to the alignment marks 22 via the reference marks 411. In other words, using the imaging means 500, the reference marks 411 are imaged through the alignment mask 410 via the penetrated holes 421 of the holding table 420, and the alignment marks 22 of the ink-jet recording heads 220 are also imaged via the penetrated holes 431 of the base jig 430 and the communicating holes 442 of the spacer jig 440.

The imaging means 500 includes a microscope and a CCD camera having an optical system, and is disposed to the holding table 420, on the opposite side to the alignment mask 410. In addition, the imaging means 500 is fixed to the apparatus body (not shown) so that the optical axis can pass in a direction to the alignment mark 22 through the reference mark 411. Hence, by moving the holding table 420 in a direction perpendicular to the optical axis of the imaging means 500, the plurality of reference marks 411 and the plurality of alignment marks 22 can be imaged by the imaging means 500. Note that, in this embodiment, the imaging means 500 is fixed to the apparatus body, and the holding table 420 is moved in the direction perpendicular to the optical axis of the imaging means 500. However, the present invention is not limited to this. For example, the holding table 420 may be fixed to the apparatus body, and the imaging means 500 may be provided so that the imaging means 500 can freely move in the direction perpendicular to the optical axis. In this case, however, this optical axis aberration tends to occur. Now, suppose that the two imaging means 500 are respectively provided to the two reference marks 411 with which the two alignment marks 22 of the ink-jet recording head 220 are respectively aligned. In this case, it is only necessary to move the holding table 420 only in a side-by-side direction of the ink-jet recording heads 220 (side-by-side direction of the nozzle lines 21A). Moreover, by providing a number of the imaging means 500 as corresponding to all the reference marks 411, it is no longer necessary to relatively move the imaging means 500 and the holding table 420, so that both can be fixed to the apparatus body.

In this embodiment, a pushing means 450, which pushes the ink-jet recording heads 220 against the fixing plate 250, is provided to the alignment apparatus 400. In this embodiment, the pushing means 450 is detachably provided to the base jig 430. Specifically, the pushing means 450 includes an arm portion 451 and pushing portions 453. The arm portion 451 has a U-shape, and is disposed over the ink-jet recording heads 220, while both ends thereof are detachably fixed to the base jig 430. The pushing portions 453 are provided to the arm portion 451, and push the respective ink-jet recording heads 220 toward the fixing plate 250.

The pushing portions 453 are respectively provided to regions of the arm portion 451, which correspond to the ink-jet recording heads 220. In this embodiment, since the four ink-jet recording heads 220 are fixed to the one fixing plate 250, the four pushing portions 453 are provided, the number of which is equal to that of the ink-jet recording heads 220.

The pushing portions 453 each has a pushing pin 454, energizing means 455, and a pushing die 459. The pushing pin 454 has a cylindrical shape, and is inserted into and movably provided to the arm portion 451 in the axis direction thereof. The energizing means 455 is provided to the base end of the pushing pin 454, and energizes the pushing pin 454 toward the ink-jet recording head 220. The pushing die 459 is disposed between the pushing pin 454 and the ink-jet recording head 220.

The pushing pin 454 has the hemispherical-shaped tip end, and is in point-contact with the pushing die 459 so as to push the pushing die 459.

The energizing means 455 is also provided to the arm portion 451, and energizes the pushing pin 454 toward the ink-jet recording head 220. In this embodiment, the energizing means 455 has a screw holding portion 456, a screw portion 457 and an energizing spring 458. The screw holding portion 456 encloses the base end of the pushing pin 454. The screw portion 457 is screwed in the screw holding portion 456. The energizing spring 458 is provided between the tip end surface of the screw portion 457 and the base end portion of the pushing pin 454.

The energizing means 455 can adjust the magnitude of pressure that the energizing screw 458 pushes the pushing pin 454, in accordance with the amount of tightening of the screw portion 456 on the screw holding portion 456. This allows the energizing means 455 to adjust the magnitude of pressure that the pushing pin 454 pushes the pushing die 459.

The pushing die 459 is disposed between the pushing pin 454 and the protective plate 30 of the ink-jet recording head 220. The pushing pin 454 is in point-contact with the upper surface of the pushing die 459, and capable of pushing the ink-jet recording head 220 while transmitting the pushing force of the pushing pin 454 uniformly onto almost the entire surface of the protective surface 30 of the ink-jet recording head 220. This makes the pushing die 459 to entirely push the ink-jet recording head 220 rather than bringing the tip end of the pushing pin 454 to directly contact with the protective plate 30 of the ink-jet recording head 220. As a result, the ink-jet recording head 220 can be more securely fixed to the fixing plate 250. Incidentally, the pushing die 459 has the same size as that of the outer shape of the protective plate 30 of the ink-jet recording head 220, or has a little smaller outer shape.

The pushing means 450 is removable from the holding table 420 together with the base jig 430. Thus, when the plurality of base jigs 430 and the plurality of pushing means 450 are prepared in advance, the pushing means 450 and the base jigs 430 can be removed from the holding table 420, while the adhesive agent to bond the ink-jet recording heads 220 and the fixing plate 250 is cured. The alignment apparatus 400 can be used to assemble the next head unit. Accordingly, the cost for the alignment apparatus 400 can be reduced.

According to this alignment apparatus 400, by moving the alignment mark 22 of the ink-jet recording heads 220 to the single hole of the reference mark 411 of the alignment mask 410 at a predetermined interval while concurrently imaging the alignment mark 22 and the reference mark 411 using the imaging means 500, the ink-jet recording heads 220 can be aligned to predetermined positions relative to the alignment mask 410.

Figure 8A:
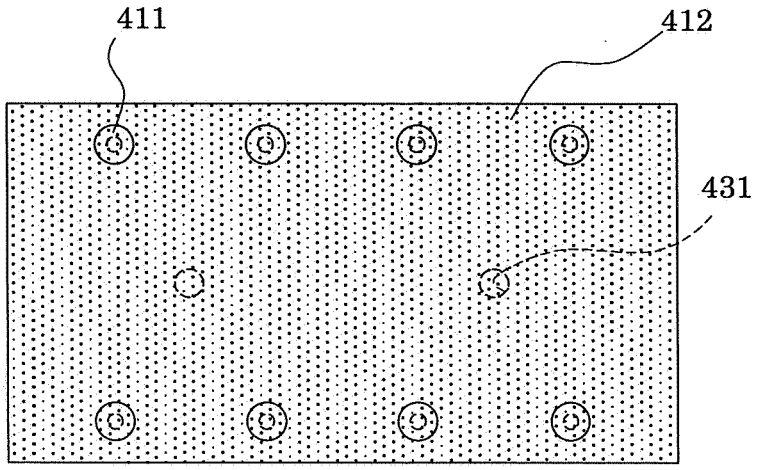
FIGS. 8A to 8C are plan views showing an alignment method according to the first embodiment.
Figure 8B:
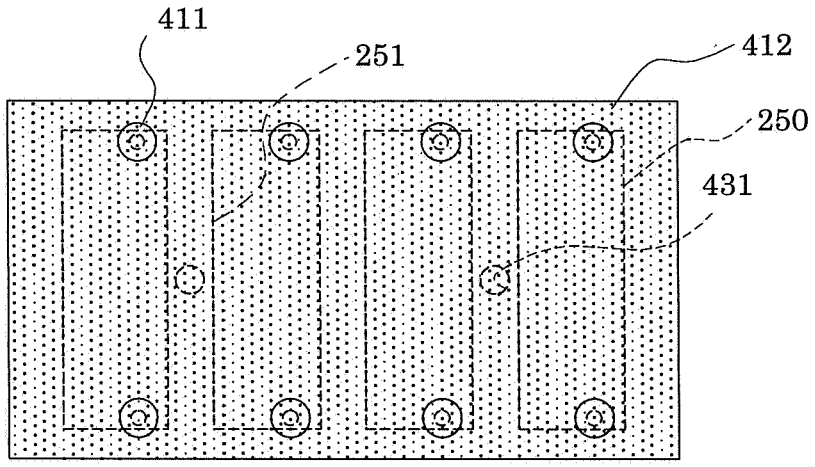
Figure 8C:
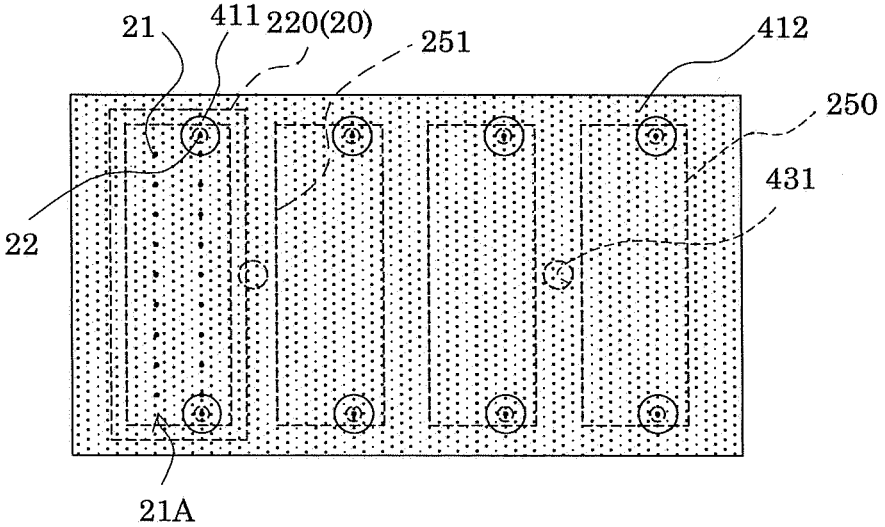
Figure 9:
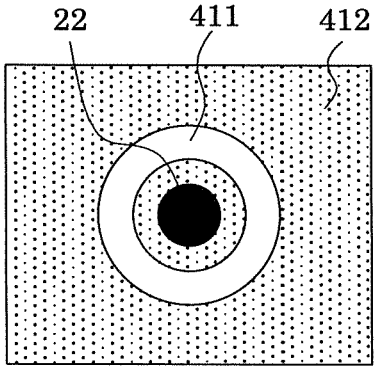
FIG. 9 is a plan view showing an image captured by imaging means according to the first embodiment.

Hereinafter, an alignment method of the head unit using the alignment apparatus 400 is further described in detail. Note that, FIGS. 8A to 8C are plan views, viewed from the bottom surface of the alignment mask, and also showing the alignment method of a head unit. FIG. 9 is an example showing an image captured by the imaging means.

As shown in FIG. 8A, the reference mark 411 of the alignment mask 410 is aligned with the center of the optical axis of the imaging means 500. To be more specific, while the reference mark 411 is imaged, using the imaging means 500, from the bottom surface of the alignment mask 410 that is a transparent member, the holding table 420 is moved so as to align the center of the reference mark 411 with the center of the imaging means 500.

Subsequently, as shown in FIG. 8B, the fixing plate 250 is suctioned and held on the base jig 430 with the spacer jig 440 interposed therebetween.

Next, as shown in FIG. 8C, the reference mark 411 of the alignment mask 410 and the alignment mark 22 on the nozzle plate 20 of the ink-jet recording head 220 are concurrently imaged, using the imaging means 500, in a state where the ink-jet recording head 220 and the fixing plate 250 are bonded with the adhesive agent. At the same time, the alignment mark 22 is moved to the single holes of the reference marks 411 at a predetermined interval.

At this time, as shown in FIG. 9, in the image captured by concurrently imaging the alignment mark 22 and the reference mark 411 using the imaging means 500, the reference mark 411 is shown in a white (whitish) color, and the alignment mark 22 is shown in a black (blackish) color. In this embodiment, an image is captured using the imaging means 500, so that the reference mark 411 is shown in a white (whitish) color and that the alignment mark 22 is shown in a black (blackish) color. The capturing of an image is not limited to this. For example, by reversing the color with image processing, the reference mark 411 can be shown in a black (blackish) color, while the alignment mark 22 can be shown in a white (whitish) color. In other words, in the image captured by the imaging means 500, it is only necessary that the reference mark 411 be shown in one of blackish and whitish colors, and the alignment mark 22 be shown in the other of blackish and whitish colors.

Moreover, in this embodiment, the surface treatment is performed on the surface of the alignment mask 410 on which the reference marks 411 are provided, to form the thin surface treatment film 412 as described above. Accordingly, the surface treatment film 412 is shown as the background in a gray color, having a high contrast ratio to each black alignment mark 22 and white reference mark 411. As a result, after performing the image processing, the boundary between the reference mark 411 and the background, and the boundary between the alignment mark 22 and the background can be detected with high accuracy, so that the alignment accuracy can be enhanced. Here, the surface treatment film 412 is provided on the entire one surface of the alignment mask 410. If the surface treatment film 412 is too thick, the alignment mark 22 formed on the nozzle plate 20 cannot be recognized through the alignment mask 410. Thus, the thickness of the surface treatment film 412 should not be large. On the other hand, if the surface treatment film 412 is too thin, the contrast ratio between the background of the nozzle plate 20 and the alignment mark 22 is not so high that the alignment mark 22 cannot be recognized. Thus, the thickness of the surface treatment film 412 is limited to some extent.

Note that, suppose a case where the background of the image captured by the imaging means 500 is the nozzle plate 20 made of stainless steel. In this case, when the boundary between the reference mark 411 and the background is detected by performing image processing, the variation in the boundary is in the range of 0.7 μm to 1 μm. In contrast, when the surface treatment is performed on the surface of the alignment mask 410 as in the case of this embodiment, the variation on the boundary between the reference mark 411 and the background can be reduced to be approximately in the range of 0.25 μm to 0.3 μm. Thus, the alignment accuracy can be enhanced.

Note that, a fine adjustment on the movement of the ink-jet recording head 220 relative to the fixing plate 250 can be performed by, for example, an unillustrated micrometer. Using a CCD camera as the imaging means 500, image processing can also be performed on the image captured by the CCD camera. Then, the ink-jet recording heads 220 may be automatically moved so that the micrometer can be driven by a drive motor or the like to align the alignment mark 22 with the reference mark 411.

Thereafter, by repeating the processes shown in FIGS. 8A to 8C, the plurality of ink-jet recording heads 220 are sequentially aligned with the fixing plate 250. Then, the plurality of ink-jet recording heads 220 and the fixing plate 250 can be joined by curing an adhesive agent therebetween, while pushing the plurality of ink-jet recording heads 220 against the fixing plate 250 at a predetermined magnitude of pressure using the pushing means 450 shown in FIGS. 6A and 6B. It is needless say that, while pushing the ink-jet recording heads 220 against the fixing plate 250 at a predetermined magnitude of pressure using the pushing means 450, the ink-jet recording heads 220 may be aligned. Alternatively, after completing the alignment, the pushing force by the pushing means 450 may be increased.

In this manner, the fixing plate 250 and the plurality of ink-jet recording heads 220 are aligned with each other to be thereafter bonded, whereby the fixing plate 250 and the nozzle lines 21A can be aligned with high accuracy. In addition, the nozzle lines 21A which belong to the different ink-jet recording heads 220 can be relatively aligned with each other with high accuracy. Furthermore, since the ink-jet recording head 220 is brought into contact with and thus joined to the fixing plate formed of a flat plate, the ink-ejecting directions of the plurality of ink-jet recording heads 220 can be relatively aligned by only joining the ink-jet recording head 220 to the fixing plate 250. Hence, it is not necessary to align the ink-ejecting directions of the plurality of ink-jet recording heads 220, and thereby improper landing of the ink droplets can be securely prevented.

Meanwhile, as shown in FIGS. 1 and 2, the cover head 240, having a box shape so as to cover the plurality of ink-jet recording heads 220, is provided to the head unit 200 on the opposite side to the ink-jet recording heads 220 with respect to the fixing plate 250. This cover head 240 includes fixing portions 242, and side wall portions 245. The fixing portions 242 are provided with opening portions 241 corresponding to the exposure opening portions 251 of the fixing plate 250. The side wall portions 245 are provided on the side surfaces of the ink-droplet-ejection surfaces of the ink-jet recording heads 220, as being bent along the outer periphery of the fixing plate 250.

In this embodiment, the fixing portion 242 includes a frame portion 243, and beam portions 244. The frame portion 243 is provided as corresponding to the fixing frame portion 253 of the fixing plate 250. The beam portions 244 are provided as corresponding to the fixing beam portions 254 of the fixing plate 250, and divide the opening portion 241. The fixing portion 242 including the frame portion 243 and the beam portions 244 is joined to the joining portion 252 of the fixing plate 250.

In this manner, since the ink-droplet-ejection surfaces of the ink-jet recording heads 220 and the cover head 240 are joined with no gap therebetween, a recorded medium is prevented from entering the gap, so that the deformation of the cover head 240 and the paper jam can be prevented. In addition, the side wall portions 245 of the cover head 240 cover the outer periphery portion of the plurality of ink-jet recording heads 220, whereby inks can be securely prevented from running out to the side faces of the ink-jet recording heads 220.

For the cover head 240, for example, a metallic material such as stainless steel may be used. The cover head 240 may be formed by pressing a metallic plate, or may be formed by means of molding. When the head cover 240 is formed of a conductive metallic material, it can be grounded. Moreover, the cover head 240 needs some strength so as to protect the ink-jet recording head 220 from an impact due to wiping, capping, or the like. Thus, the thickness of the cover head 240 needs to be comparatively thick. In this embodiment, the thickness of the cover head 240 is 0.2 mm.

Note that, the way of joining the cover head 240 to the fixing plate 250 is not particularly limited. The joining can be made by means of bonding using, for example, a thermosetting epoxy adhesive agent.

The fixing portion 242 is provided with flange portions 246, on which fixing holes 247 are provided to position and fix the cover head 240 to another member. The flange portions 246 are bent so as to protrude from the side wall portion 245 in the same direction as the surface direction of the liquid-droplet-ejection surface. In this embodiment, as shown in FIGS. 2 and 3, the cover head 240 is fixed to the cartridge case 210, being a holding member, on which the ink-jet recording head 220 and the head case 230 are held.

Specifically, as shown in FIGS. 2 and 3, the cartridge case 210 is provided with protrusions 215, which protrude on the ink-droplet-ejection surface side, and which are inserted into the fixing holes 247 of the cover head 240. The protrusions 215 are inserted into the fixing holes 247 of the cover head 240, and the tip ends of the protrusions 215 are heated and caulked, whereby the cover head 240 is fixed to the cartridge case 210. The protrusions 215 provided to the cartridge case 210 as described above is formed to have a smaller outer diameter than that of the fixing hole 247 of the flange portion 246, whereby the cover head 240 can be positioned in the surface direction of the ink-droplet-ejection surface, and fixed to the cartridge case 210.

In addition, the cover head 240 and the fixing plate 250 joining to the plurality of ink-jet recording heads 220 are fixed to each other through the positioning of the fixing holes 247 of the cover head 240 and the plurality of nozzle lines 21A. The positioning of the fixing holes 247 of the cover head 240 and the plurality of nozzle lines 21A can be performed using the above-described alignment apparatus. However, when the fixing plate 250 and the plurality of ink-jet recording heads 220 are aligned with and fixed to each other, the cover head 240 may be simultaneously aligned therewith and fixed thereto.

Second Embodiment

Figure 10:
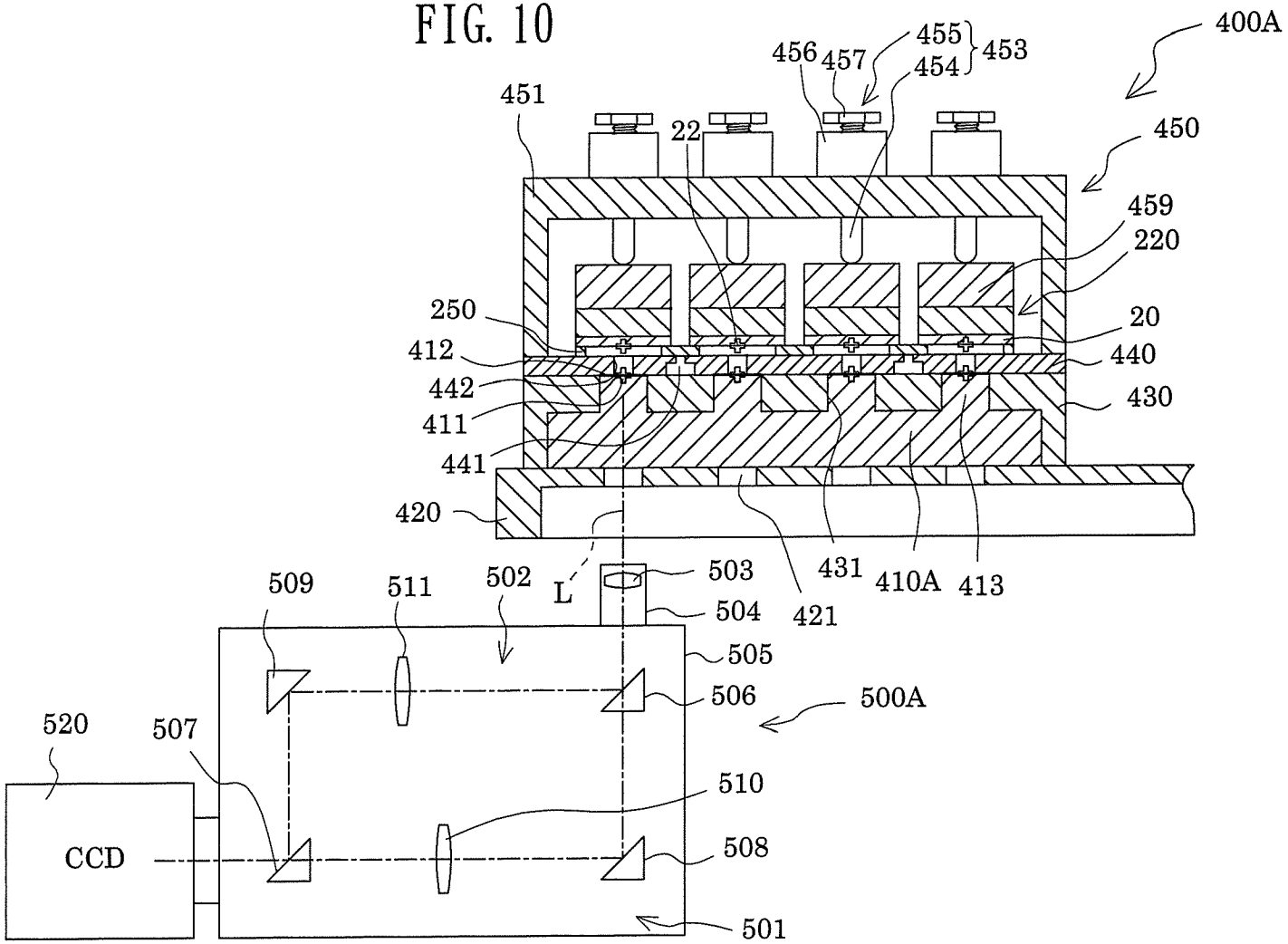
FIG. 10 is a cross-sectional view of an alignment apparatus according to a second embodiment.

FIG. 10 is a cross-sectional view showing an alignment apparatus according to a second embodiment of the invention. In the following description, those components which are the same as or similar to those shown in the first embodiment are given the same or similar symbols, and hence the description of the same or similar components will be omitted.

As shown in FIG. 10, an alignment apparatus 400A according to the present embodiment includes an alignment mask 410A, the holding table 420, the base jig 430, the spacer jig 440 and imaging means 500A.

The alignment mask 410A is provided with protrusions 413, the upper surfaces of which are respectively provided with the reference marks 411, and which protrude into the penetrated holes 431 of the base jig 430.

In this embodiment, each protrusion 413 is provided with the reference mark 411, and has a cylindrical shape. In this embodiment, since the four ink-jet recording head 220 are fixed to the fixing plate 250, the eight protrusions in total, each having the reference mark 411, are provided.

On the tip end surface of the protrusion 413 to which the reference marks are provided, the surface treatment film 412 formed of a thin film is provided. In this embodiment, the surface treatment film 412 is provided only to the tip end surface of the protrusion 413, and not provided to the other surfaces of the alignment mask 410A. In this configuration also, the surface treatment film 412 is shown as the background of the image captured by the imaging means 500A.

Moreover, it is preferable that the protrusion 413 be formed to have a height such that the reference mark 411 provided to the tip end surface is close to the alignment mark 22 of the nozzle plate 20. This is to enhance the positioning accuracy by making the distance between the alignment mark 22 and the reference mark 411 short. In other words, for example, when the distance between the reference mark 411 and the alignment mark 22 is long, the positioning is difficult, and hence the alignment accuracy cannot be enhanced. In addition, when the distance between the reference mark 411 and the alignment mark 22 is long, the optical axis of the imaging means 500 is deviated to a large extent due to the heat generated by a metal halide lamp or the like which is used when the positions are checked by the imaging means 500A, including the CCD camera and the microscope. As a result, large errors are produced in the actual positions of the reference marks 411 and the alignment marks 22.

Note that, when the protrusions 413 are not provided to the alignment mask 410A, and concurrently when the distance between the alignment mark 22 and the reference mark 411 is, for example, approximately 5.1 mm, the optical axis aberration is approximately 2.5 μm at maximum. In this embodiment, by providing the protrusions 413 to the alignment mask 410A, the distance between the reference mark 411 and the alignment mark 22 becomes 110 μm or less. Accordingly, the optical axis aberration of the optical system in the imaging means 500 due to the heat as described above can be made 0.05 μm or less, and hence the positioning with high accuracy can be performed.

When the protrusion 413 is too close to the nozzle plate 20, the adhesive agent used for bonding the nozzle plate 20 and the fixing plate 250 may be adhered to the tip end surface of the protrusion 413, and consequently it may be impossible to check the alignment marks 22 and the reference marks 411 using the imaging means 500A. Therefore, it is preferable that the tip end surface of the protrusion 413 be placed away from the nozzle plate 20 at a predetermined distance.

As described above, by providing the protrusions 413 to the alignment mask 410A, the distance between the alignment mark 22 and the reference mark 411 is made short. Accordingly, it is not necessary to make the distance between the alignment mark 22 and the reference mark 411 short by forming the base jig 430 and the spacer jig 440 to have small thicknesses. In other words, suppose a case where the base jig 430 and the spacer jig 440 are formed to have small thicknesses in order to make the distance between the alignment mark 22 and the reference mark 411 short. In this case, the base jig 430 may be deformed or destroyed when the ink-jet recording head 220 is pushed against the fixing plate 250. Thereby, an alignment error occurs between the reference mark 411 and the alignment mark 22. In this embodiment, since the protrusions 413 are provided to the alignment mask 410A, it is not necessary to form the base jig 430 to have a small thickness. Thus, the base jig 430 has some rigidity and can be prevented from being deformed or damaged. Therefore, the alignment can be performed with high accuracy.

Moreover, in this embodiment, while the eight protrusions of a cylindrical shape are provided to the alignment mask 410A, the invention is not limited to the above-described configuration. For example, to each ink-jet recording head 220, one protrusion may be provided. In other words, the alignment mask for performing an alignment on one head unit may be provided with the four protrusions. In this case, it is only necessary that the penetrated holes 431 of the base jig 430 have the same shapes as those of the protrusions. The presence of such penetrated holes does not reduce the rigidity of the base jig 430.

The imaging means 500A is configured by a two-focus microscope, and includes two optical systems sharing the same optical axis L. The optical axis L is directed in a direction (a perpendicular direction in the drawing) in which the optical axis L passes to the alignment mark 22 through the reference mark 411 from the alignment mask 410A on the opposite side to the fixing plate 250. The optical system is configured so that the system can focus on the reference mark 411, i.e. an upper surface of the alignment mask 410A.

Specifically, an objective lens 503 is housed in a lens-barrel 504 in a state where the optical axis L is directed in the direction of the reference mark 411 and the alignment mark 22. The lens-barrel 504 is fixed to a case 505. In the case 505, two beam splitters 506, 507, and two mirrors 508, 509 and two focusing lens 510, 511 are housed.

An optical system 501 includes the beam splitter 506, the mirror 508, the focusing lens 510 and the beam splitter 507. The optical system 501 has an optical path (shown by the chain line in the drawing) in which the light passed through the beam splitter 506 is reflected on the mirror 508, passes through the focusing lens 510, and thereafter the light goes out through the beam splitter 507.

Another optical system 502 includes the beam splitter 506, the focusing lens 511, the mirror 509 and the beam splitter 507. The optical system 502 has an optical path (shown by the chain line in the drawing) in which the light reflected on the beam splitter 506 passes through the focusing lens 511, then reflected on the mirror 509 and the beam splitter 507, and thereafter the light goes out.

A CCD 520 captures and performs a reproduction process on the images of the reference mark 411 and the alignment mark 22 concurrently through the optical systems 501 and 502. Here, the image of the reference mark 411 is provided on the CCD 520 by adjusting the focusing position of the focusing lens 510, while the image of the alignment mark 22 is provided on the CCD 520 by adjusting the focusing position of the focusing lens 511 to combine the images. In this manner, the clear image of the reference mark 411 and the alignment mark 22, which are separately focused, can be provided to the CCD 520. A predetermined alignment is, thus, performed by adjusting the positions of the ink-jet recording heads 220 so that these two images can overlap.

Using the imaging means 500A configured by such a two-focus microscope, the optical systems 501 and 502, which share the optical axis L, can separately focus on objects (the reference mark 411 and the alignment mark 22) which are placed at different positions. Thus, by making the depths of field of the respective objects shallow, and the clear image of the reference mark 411 and the alignment mark 22 can be captured with sufficiently large magnifications. Therefore, the alignment marks 22 can be aligned with the reference marks 411 with high accuracy.

Note that, as in the case of the first embodiment, two imaging means 500A each configured by the two-focus microscope may be provided. Specifically, the imaging means 500A may be provided as corresponding to the two alignment marks 22 of the ink-jet recording head 220. Moreover, the plurality of imaging means 500 each configured by the two-focus microscope may be provided as corresponding to the respective reference marks 411.

In this embodiment, while one CCD 520 captures images in the two optical systems 501 and 502, the two CCDs may be provided to the respective optical systems 501 and 502, and images captured by the two CCDs may be composed.

Third Embodiment

Figure 11A:
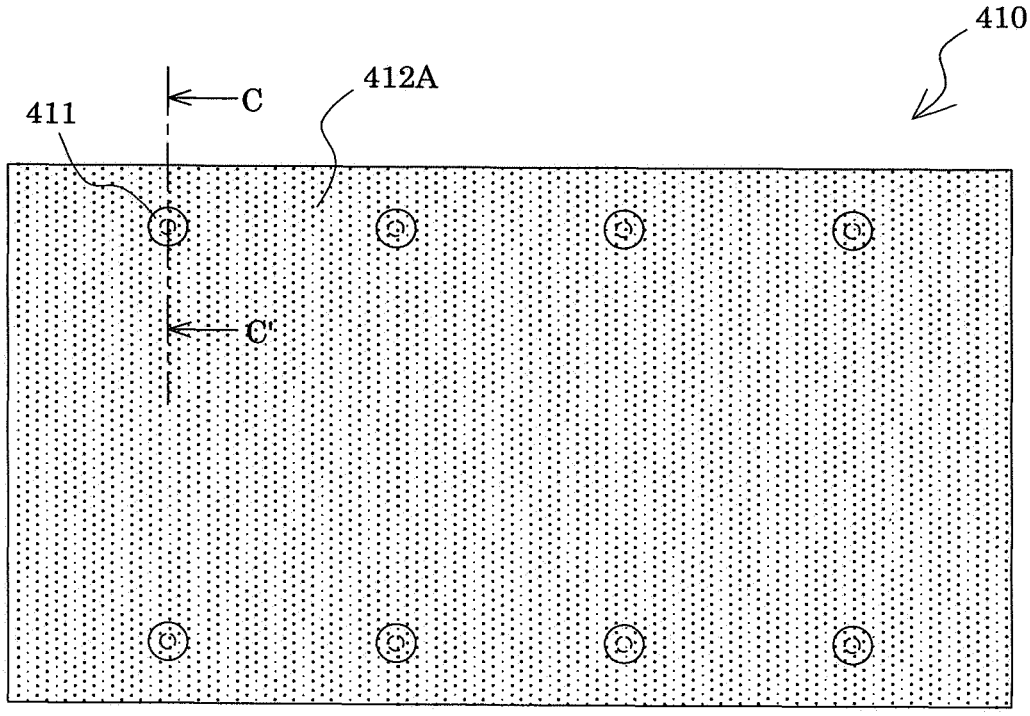
FIGS. 11A and 11B are respectively a plan view and a cross-sectional view of an alignment mask according to a third embodiment.
Figure 11B:
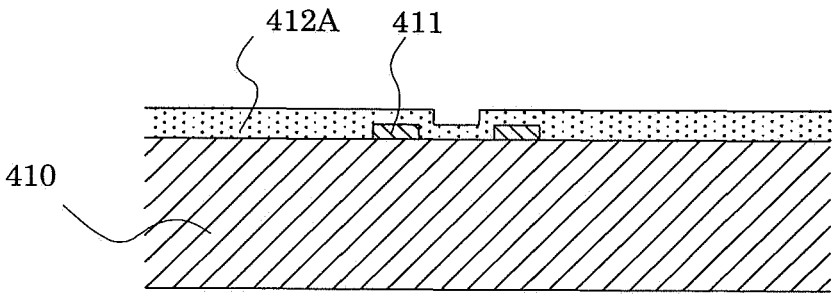

FIG. 11A are a plan view of an alignment mask according to a third embodiment of the invention, and FIG. 11B is a cross-sectional view taken along the line C-C' in FIG. 11A. In the following description, those components which are the same as or similar to those shown in the first and second embodiments are given the same or similar symbols, and the description of the same or similar components will be omitted.

As shown in FIGS. 11A and 11B, one surface of the alignment mask 410 according to this embodiment is provided with the reference marks 411 of annular shapes. On the surface of the alignment mask 410 on which the reference marks 411 are provided, a surface treatment is performed. In this embodiment, a surface treatment film 412A is provided by performing the surface treatment.

Such a surface treatment film 412A is provided so that, when an image is captured by the imaging means 500, the contrast ratio of the surface treatment film 412A to each of the blackish alignment mark 22 and the whitish reference mark 411 can be high on the inside of the reference mark 411 of the annular shape. In addition, the surface treatment film 412A is provided so that the contrast ratio of the surface treatment film 412A to the reference mark 411 on the outside of the reference mark 411 is higher than that on the inside thereof. In this embodiment, the surface treatment film 412A is provided on the inside of the reference mark 411 to have the same thickness as that described in the first embodiment, and to have a larger thickness on the outside of the reference mark 411 than that on the inside thereof.

As the surface treatment on the alignment mask 410, the surface treatment film 412A is provided so that the contrast ratio of the surface treatment film 412A to each of the alignment mark 22 and the reference mark 411 can be high on the inside of the reference mark 411, and that the contrast ratio to the reference mark 411 on the outside of the reference mark 411 can be higher than that on the inside thereof. Thus, the reference marks 411 can be easily detected. In addition, an edge on the outer periphery of the reference marks 411 can be detected with high accuracy.

Note that, in this embodiment, the surface treatment film 412A is provided as the surface treatment on the alignment mask 410. Accordingly, the surface treatment film 412A is formed to have different thicknesses on the inside and outside of the reference mark 411. However, the surface treatment is not limited to this. For example, even if colored-film pasting, a blast process, or the like, is performed, similar effects are obtained. More specifically, when a colored film is pasted, the thicknesses of the colored film may be altered on the inside and outside of the reference mark 411. In addition, the color density of the colored film may be altered on the inside and outside of the reference mark 411. In the case of the blast process, the periods of time during which the blast processes are performed may be altered on the inside and outside of the reference mark 411.

Fourth Embodiment

Figure 12A:
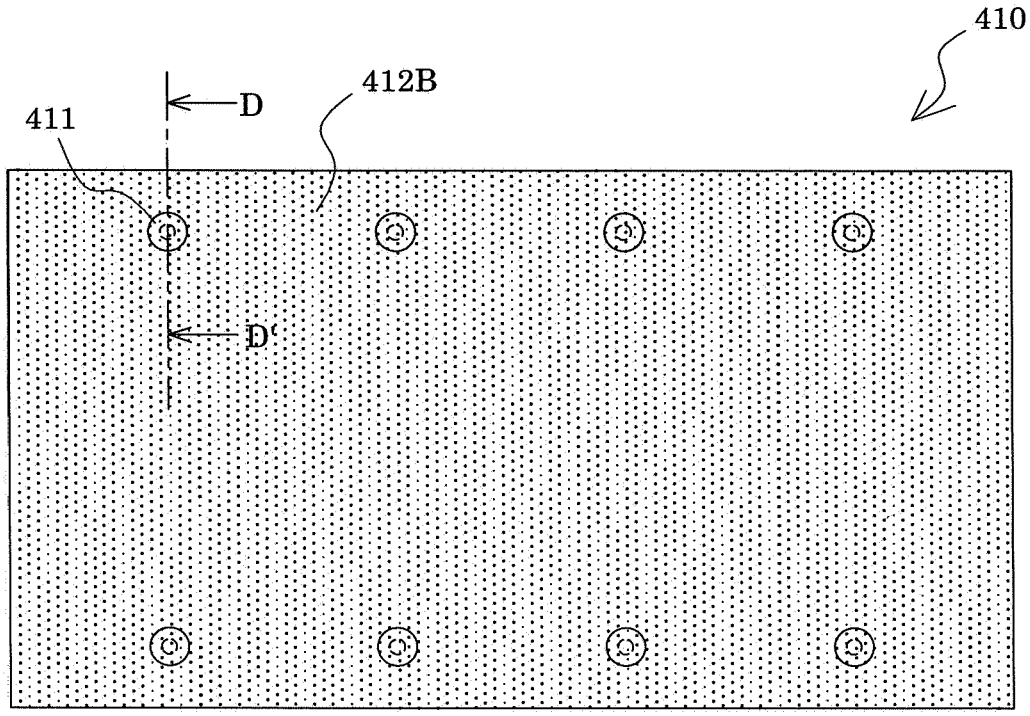
FIGS. 12A and 12B are respectively a plan view and a cross-sectional view of an alignment mask according to a fourth embodiment.
Figure 12B:
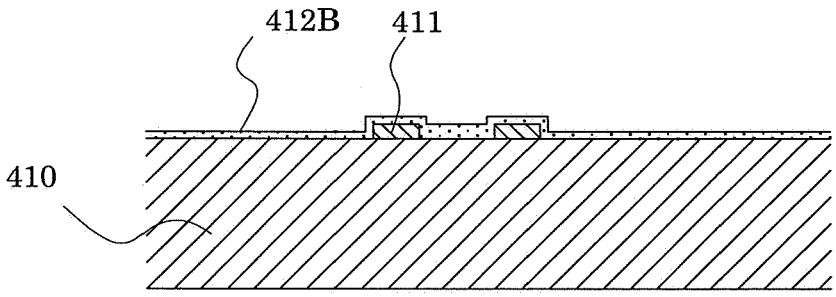

FIG. 12A is a plan view of an alignment mask according to a fourth embodiment of the invention, and FIG. 12B is a cross-sectional view taken along the line D-D' in FIG. 12A. In the following description, those components which are the same as or similar to those shown in the embodiments described above are given the same or similar symbols, and the description of the same or similar components will be omitted.

As shown in FIGS. 12A and 12B, one surface of the alignment mask 410 according to this embodiment is provided with the reference marks 411 of annular shapes. On the surface of the alignment mask 410 on which the reference marks 411 are provided, a surface treatment is performed. In this embodiment, a surface treatment film 412B is provided by performing the surface treatment.

Such a surface treatment film 412B is provided so that, when an image is captured by the imaging means 500, the contrast ratio of the surface treatment film 412B to each of the blackish alignment mark 22 and the whitish reference mark 411 can be high on the inside of the reference mark 411 of the annular shape. In addition, the surface treatment film 412B is provided so that the contrast ratio of the surface treatment film 412B to the reference mark 411 on the outside of the reference mark 411 is higher than that on the inside thereof. In other words, the surface treatment film 412B is provided so that the contrast ratio of the surface treatment film 412B to the alignment mark 22 on the outside of the reference mark 411 is higher than that on the inside thereof. In this embodiment, the surface treatment film 412B is provided on the inside of the reference mark 411 to have the same thickness as that described in the first embodiment, and to have a smaller thickness on the outside of the reference mark 411 than that on the inside thereof.

As the surface treatment on the alignment mask 410, the surface treatment film 412B is provided so that the contrast ratio of the surface treatment film 412B to each of the alignment mark 22 and the reference mark 411 can be high on the inside of the reference mark 411, and that the contrast ratio to the reference mark 411 on the outside of the reference mark 411 is lower than that on the inside thereof (the contrast ratio to the alignment mark 22 is higher). Thus, the alignment marks 22 can be easily detected when the alignment marks 22 are placed on the outside of the reference marks 411.

Note that, in this embodiment, the surface treatment film 412B is provided as the surface treatment on the alignment mask 410. Accordingly, the surface treatment film 412B is formed to have different thicknesses on the inside and outside of the reference mark 411. However, the surface treatment is not limited to this. For example, even if colored-film pasting, a blast process, or the like, is performed, similar effects are obtained. More specifically, when a colored film is pasted, the thicknesses of the colored film may be altered on the inside and outside of the reference mark 411. In addition, the color density of the colored film may be altered on the inside and outside of the reference mark 411. In the case of the blast process, the periods of time during which the blast processes are performed may be altered on the inside and outside of the reference mark 411.

Other Embodiment

Although the embodiments of the invention have been disclosed for illustrative purpose, it will be recognized that the basic configuration of the invention is not limited to the above-described embodiments. In the first to fourth embodiments, as the surface treatment on the alignment mask 410, the surface treatment film 412 formed of the thin film is provided using a sputtering method or a vapor deposition method. However, the surface treatment is not limited to this. For example, as the surface treatment on the alignment mask, a colored film may be pasted, or a blast process may be performed. Incidentally, the blast process is performed not to remove the alignment marks 411 of the alignment mask 410 to form an asperity on the region other than the alignment marks 411 so that the background in the image captured by the imaging means 500 or 500A can be shown in a gray color.

In the above-described first to fourth embodiments, the alignment mark 22 has a circular shape, while the reference mark 411 has an annular shape. However, the shapes of these marks 22, 411 are not limited to these. For example, the alignment mark 22 and the reference mark 411 are not limited to a specific shape such as a rectangle. When other shapes are employed, the alignment mark 411 provided to the nozzle plate 20 may be formed through a process or method different from those used for the nozzle orifice 21.

Moreover, in the above-described first to fourth embodiments, while the alignment mask 410 is formed of one member, the alignment mask 410 may be also formed by stacking a plurality of flat plates made of transparent members. For example, when two plates are to be stacked to form an alignment mask, the reference marks 411 and the surface treatment films 412, 412A, 412B may be provided on the surface of the one plate. Then, the other plate may be joined to the surface treatment films 412, 412A, 412B of the one plate. In this manner, the reference marks 411 and the surface treatment films 412, 412A, 412B are not abraded due to contact with an external object. In other words, the problem in the invention can be solved even when the reference marks 411 and surface treatment films 412, 412A, 412B are not formed on the surface of the nozzle plate 20 side of the alignment mask 410. It is certain that the reference marks 411 may be provided to the surface of one plate, and the surface treatment films 412, 412A, 412B may be provided on the surface of the other plate, which is on the side of the nozzle plate 20, and on which the reference marks 411 are joined.

In addition, in the above-described first to fourth embodiments, the imaging means 500, 500A capture an image in which the reference mark 411 is shown in a white (whitish) color, and in which the alignment mark 22 is shown in a black (blackish) color. However, the embodiment is not limited to this. The imaging means 500, 500A may capture a color image. Specifically, even when the reference mark 411 and the alignment mark 22 are captured and shown in colors other than whitish and blackish colors, it is still possible to increase the visibility by performing a surface treatment so that the contrast ratio to each of the alignment mark 22 and the reference mark 411 can be high.

Furthermore, in the above-described first to fourth embodiments, a water repellent film, which increases water repellency, is actually formed on the ink-droplet-ejection surface of the nozzle plate 20. For this water repellent film, for example, a metallic film may be used, but not particularly limited thereto. It is preferable that the metallic film be provided only to a region which is exposed through the exposure opening portion 251 of the fixing plate 250. This is because, when the fixing plate 250 is joined to the ink-droplet-ejection surface, the bonding force of an adhesive agent is reduced. The metallic film can be formed with high accuracy at a predetermined thickness by means of eutectoid plating, for example.

In the above-described first to fourth embodiments, the pushing means 450 is provided to the alignment apparatuses 400, 400A. However, the embodiment is not limited to those described above. Now, suppose that a UV cure adhesive agent is used as the adhesive agent to join the fixing plate 250 and the ink-jet recording head 220. Then, the adhesive agent is applied to the joining surface of the fixing plate 250, and thereafter a UV light is irradiated on the adhesive agent to cure while the fixing plate 250 and the ink-jet recording head 220 are in contact with each other. As a result, the fixing plate 250 and the ink-jet recording head 220 can be joined to each other, and hence the pushing means 450 can be eliminated. Note that, the UV cure adhesive agent is not necessary to cure by pushing the fixing plate 250 and the ink-jet recording head 220 at a predetermined magnitude of pressure as in the case of the thermosetting adhesive agent, but the application of a pressure is capable of preventing the ink-jet recording head 220 and the fixing plate 250 from being out of alignment. As a result, both can be joined with high accuracy. Moreover, in the joining with the UV cure adhesive agent, the bonding strength is comparatively small. Thus, after the fixing plate 250 and the ink-jet recording head 220 are joined with the UV cure adhesive agent, it is only necessary to fix, using the thermosetting adhesive agent, the periphery of the corners and the like which are defined by the ink-jet recording head 220 and the fixing plate 250. Thus, the fixing plate 250 and the ink-jet recording head 220 are firmly joined with high accuracy, and thus the reliability is improved.

Moreover, in the above-described first to fourth embodiments, as the fixing member for joining to the plurality of ink-jet recording heads 220, the fixing 250 formed of the flat plate has been exemplified. However, the fixing member is not limited to the fixing plate 250. For example, the plurality of ink-jet recording heads 220 may be directly positioned and joined to the cover head 240. In this case also, using the alignment masks 410, 410A and the alignment method according to the above-described first and second embodiments, the positioning and the bonding can be performed with high accuracy.

In addition, in the above-described first to fourth embodiments, a flexural vibration ink-jet recording head 220 has been exemplified. However, the type of recording head is not limited to this. The invention is employed to head units including various types of ink-jet recording heads: a longitudinal vibration ink-jet recording head in which a piezoelectric material and an electrode forming material are alternately stacked, and then expands and contracts in the axis direction; an ink-jet recording head which ejects ink droplets with the bubbles generated from, for example, a heat element; and the like.

Incidentally, the alignment method of a head unit, having the ink-jet recording head which ejects inks as a liquid-jet head as well as the alignment mask have been described. The invention more generally targets an alignment method of a liquid-jet head unit, having a liquid-jet head as well as an alignment mask. Examples of such liquid-jet heads can include: recording heads used in image recording apparatuses such as printers; color-material-jet heads used in manufacturing color filters of liquid crystal display devices and the like; electrode-material-jet heads used in forming electrodes of organic EL display devices, SED (Surface Emission Display) devices, and the like; and bio-organic-material-jet heads used in manufacturing bio-chips.

Furthermore, the invention is not limited to the alignment method of a liquid-jet head unit, but widely applicable to an alignment method in which: an alignment mark provided to a positioned member is disposed so as to face to a reference mark provided to one surface of an alignment mask; and the alignment mark and the reference mark are concurrently imaged from the other side of the alignment mask using imaging means so as to align the alignment mark with the reference mark.

What is claimed is:

1. A method of manufacturing a liquid-jet head unit including a liquid-jet head having an alignment mark, and a fixing member holding the liquid-jet head, the method comprising:

arranging the fixing member between the liquid-jet head and an alignment mask which is made of a transparent member; and aligning a reference mark provided to a surface of the alignment mask and the alignment mark, wherein a surface treatment film directly contacts the surface of the alignment mask.

2. The method of manufacturing a liquid-jet head unit according to claim 1, wherein the surface treatment film has a high contrast ratio to the alignment mark and the reference mark.

3. The method of manufacturing a liquid-jet head unit according to claim 1, wherein, the alignment mark is formed of a penetrated hole.

4. The method of manufacturing a liquid-jet head unit according to claim 1, wherein the reference mark is formed of a metal.

5. The method of manufacturing a liquid-jet head unit according to claim 1, wherein the surface treatment film is formed of a metal.

6. The method of manufacturing a liquid jet head unit according to claim 1, wherein the thickness of the surface treatment film is smaller than the thickness of the reference mark.

7. The method of manufacturing a liquid-jet head unit according to claim 1, wherein the surface treatment film is provided on the reference mark.

8. The method of manufacturing a liquid-jet head unit according to claim 1, wherein the reference mark and the alignment mark are aligned by using imaging means.

9. The method of manufacturing a liquid-jet head unit according to claim 1, wherein the reference mark is formed on the surface of the alignment mask of the liquid-jet head side.

10. The method of manufacturing a liquid-jet head unit according to claim 1, wherein the reference mark has annular shape, and the thickness of the surface treatment film on the inside of the reference mark is smaller than the thickness of the surface treatment film on the outside of the reference mark.

11. The method of manufacturing a liquid-jet head unit according to claim 1, wherein the reference mark has annular shape, and the thickness of the surface treatment film on the inside of the reference mark is larger than the thickness of the surface treatment film on the outside of the reference mark.

12. The method of manufacturing a liquid-jet head unit according to claim 1, wherein the alignment mask has a protrusion which protrudes to the liquid-jet head side, and protrusion has the reference mark.

13. The method of manufacturing a liquid-jet head unit according to claim 1, wherein the liquid-jet head unit has a plurality of the liquid-jet heads, and aligning the plurality of the liquid-jet heads mutually by aligning a reference mark and the alignment mark.

* * * * *